US010624502B2

(12) United States Patent
Ophardt et al.

(10) Patent No.: US 10,624,502 B2
(45) Date of Patent: Apr. 21, 2020

(54) COVER ARRANGEMENT FOR FLUID DISPENSER

(71) Applicant: OP-Hygiene IP GmbH, Niederbipp (CH)

(72) Inventors: Heiner Ophardt, Arisdorf (CH); John Gerard Garry, St. Catharines (CA); Padraic Grady, Arainmhor Island (IE)

(73) Assignee: OP-Hygiene IP GmbH, Niederbipp (CH)

( * ) Notice: Subject to any disclaimer, the term of this patent is extended or adjusted under 35 U.S.C. 154(b) by 0 days.

(21) Appl. No.: 16/059,764

(22) Filed: Aug. 9, 2018

(65) Prior Publication Data

US 2018/0360275 A1 Dec. 20, 2018

Related U.S. Application Data

(63) Continuation of application No. 15/292,972, filed on Oct. 13, 2016, now Pat. No. 10,098,511.

(30) Foreign Application Priority Data

Oct. 15, 2015 (CA) ..... 2908770

(51) Int. Cl.
*A47K 5/12* (2006.01)
*B05B 11/00* (2006.01)
*B05B 15/62* (2018.01)

(52) U.S. Cl.
CPC ..... *A47K 5/1211* (2013.01); *A47K 5/1205* (2013.01); *B05B 11/3009* (2013.01); *B05B 11/3014* (2013.01); *B05B 11/3052* (2013.01); *B05B 15/62* (2018.02)

(58) Field of Classification Search
CPC ..... A47K 5/1211; A47K 5/1205; B05B 11/3014; B05B 11/3052; B05B 15/62; B05B 11/3009
See application file for complete search history.

(56) References Cited

U.S. PATENT DOCUMENTS

| | | | | |
|---|---|---|---|---|
| 2,796,201 | A | 6/1957 | Dooley, Jr. | |
| 4,324,348 | A * | 4/1982 | Johnson | A47K 5/122 222/181.2 |
| 4,615,476 | A | 10/1986 | Hobbs | |
| 7,232,045 | B2 * | 6/2007 | Ophardt | A47K 5/12 222/153.01 |
| 7,748,573 | B2 | 7/2010 | Anhuf et al. | |
| 2004/0118877 | A1 | 6/2004 | von Schuckmann et al. | |
| 2008/0110936 | A1 | 5/2008 | Ophardt | |
| 2008/0121664 | A1 | 5/2008 | Ophardt et al. | |
| 2012/0279987 | A1 | 11/2012 | Ophardt | |
| 2014/0253336 | A1 | 9/2014 | Ophardt | |
| 2015/0190827 | A1 * | 7/2015 | Ophardt | B05B 11/0037 222/153.09 |

* cited by examiner

*Primary Examiner* — Donnell A Long
(74) *Attorney, Agent, or Firm* — Thorpe North and Western, LLP

(57) ABSTRACT

A fluid dispenser having a housing and a cover removably coupled to the housing with the cover having a right cover side wall and a left cover side wall secured together spaced laterally from each other and in which the cover side walls are resilient and deflectable laterally away from each other for disengagement of the cover from the housing.

21 Claims, 27 Drawing Sheets

COVER ARRANGEMENT FOR FLUID DISPENSER

RELATED APPLICATION

This application is a continuation of co-pending U.S. patent application Ser. No. 15/292,972 filed Oct. 13, 2016 and claims the benefit of 35 U.S.C. 120.

SCOPE OF THE INVENTION

This invention relates to a cover for a fluid dispenser and, more particularly, to an arrangement for removably coupling a cover to a fluid dispenser, to an arrangement for providing a lever assembly to be removably coupled to a cover for a fluid dispenser and to a coupling arrangement by which a cover for a fluid dispenser can be moved between open and closed positions.

BACKGROUND OF THE INVENTION

Manually operated fluid dispensers are known for dispensing hand cleaning fluid onto a person's hand. Such dispensers typically have a cover to enclose the operational mechanisms of the dispensers. Such dispensers typically have surfaces which need to be engaged by a user to dispense fluid such as surfaces of a lever movable to discharge the fluid. Such dispensers also typically have other surfaces which come to be engaged by a user during use. For example, there is often a surface on the dispenser which is engaged in order to move the cover from a closed operative position to an open position as to replace a fluid containing bottle.

The present inventors have appreciated that previously known dispensers suffer the disadvantage that the surfaces of the dispenser which may be contacted by a user cannot be removed for advantageous cleaning by placing the surfaces in an autoclave or a washing machine. Many known dispensers suffer the disadvantage that their covers cannot be removed or easily removed and that levers to be engaged to disperse the cleaning fluid cannot be removed for cleaning as in an autoclave or washing machine. This difficulty is particularly acute insofar as there may be electronic equipment carried by the dispenser which prevents the entirety of the dispenser from being placed into an autoclave or a washing machine.

Previously known dispensers suffer the further disadvantage that covers for the dispensers are difficult for a user to move between open and closed positions and to remove the cover from the dispenser.

Previously known dispensers which include a cover and a lever member operative to dispense fluid from the dispenser suffer the disadvantage that the cover and the lever member are separate items which need to be independently removed from the dispenser for cleaning.

SUMMARY OF THE INVENTION

To at least partially overcome some of these disadvantages of previously known dispensers, the present invention provides a fluid dispenser having a cover assembly including a cover and a lever in which lever is removably coupled to the cover and in which the cover assembly is removably coupled to the housing for coupling and uncoupling of the cover assembly to the housing while the lever is coupled to the cover.

To at least partially overcome other of these disadvantages of previously known dispensers, the present invention provides a fluid dispenser having a housing and a cover removably coupled to the housing with the cover having a right cover side wall and a left cover side wall secured together spaced laterally from each other and in which the cover side walls are resilient and deflectable laterally away from each other for disengagement of the cover from the housing.

To overcome other of these disadvantages of previously known dispensers, the present invention provides a fluid dispenser having a cover including a right cover side wall and a left cover side wall spaced laterally from each other and joined by a top wall and in which a rod member bridges between lower portions of the side walls.

In a first aspect, the present invention provides a fluid dispenser having:

a housing, a cover assembly removably coupled to the housing for coupling and uncoupling of the cover assembly and the housing, when the cover is coupled to the housing the cover and housing define an interior compartment therebetween, the cover having a right cover side wall and a left cover side wall secured together spaced laterally from each other, the housing has a right housing side wall and a left housing side wall secured together spaced laterally from each other by a housing back wall, when the cover is coupled to the housing the right cover side wall is laterally to the right of right housing side wall, the left cover side wall is laterally to the left of housing side wall, when the cover is coupled to the housing, the right cover side wall engages the right housing side wall and the left cover side wall engages the left housing side wall, to uncouple the cover from the housing, the right cover side wall is deflected laterally away from the right housing side wall and the left cover side wall is deflected laterally away from the left housing side wall. Preferably, the cover has a top wall bridging between the right side wall and the left side wall and the top wall extends between the right cover side wall and the left cover side wall above the right housing side wall and the left housing side wall. Preferably, the cover is open at a rear of the cover, in coupling of the cover assembly and the housing while the right cover side wall is deflected laterally away from the right housing side wall and the left cover side wall is deflected laterally away from the left housing side wall the housing passes rearwardly through the open rear of the cover, and in uncoupling of the cover assembly and the housing while the right cover side wall is deflected laterally away from the right housing side wall and the left cover side wall is deflected laterally away from the left housing side wall the housing passes forwardly through the open rear of the cover.

In a second aspect, the present invention provides a fluid dispenser having:

a housing, a fluid pump, a cover assembly including a cover and a lever member, the lever member removably coupled to the cover, a cover assembly removably coupled to the housing for coupling and uncoupling of the cover assembly and the housing while the lever member is coupled to the cover, when the cover assembly is coupled to the housing, the lever member is accessible for manual engagement by a user for movement of the lever to activate the fluid pump and dispense fluid from the fluid dispenser, the lever member including an axle about an axle axis, the cover having a right side wall and a left side wall secured together spaced laterally from each other and being a mirror image of each other, each side wall having an edge, each side wall having an identical axle keyway opening extending laterally therethrough, each axle keyway opening having an enlarged journaling bore and an entry/exit slot, each slot opens into the bore, extending from the bore to the edge of the respective side wall where the slot is open through the edge of the respective side wall, the cover about each slot being resilient and having an inherent bias to adopt an inherent configuration in which the slot is sized to retain the axle in the bore against removal, the cover about the slot being deflectable from the inherent configuration to deflected conditions which permit passage of the axle through the slot into or out of from the bore for uncoupling of the lever member from the cover, when the lever member is coupled to the cover, the axle of the lever member is received in the bore of each side wall journaled therein for rotation of the lever member about the axle axis relative the cover. Preferably, the edge of each side wall is a rearwardly directed rear edge and each axle keyway opening is proximate an upper rear corner of each side wall.

In accordance with a third embodiment, the present invention provides a fluid dispenser having:

a housing, a cover assembly removably coupled to the housing, the cover having a right cover side wall and a left cover side wall secured together spaced laterally from each other and being a mirror image of each other, each cover side wall having an upper portion, a lower portion and an intermediate portion spanning between the upper portion and the a lower portion, a top bridging member bridging between the upper portion of the right cover side wall and the upper portion of left cover side wall, the top bridging member comprising a top wall, a bottom bridging member bridging between the lower portion of the right cover side wall and the lower portion of left cover side wall, the bottom bridging member comprising a rod member extending laterally between the right cover side wall and the cover left wall, the housing has a right housing side wall and a left housing side wall, when the cover is coupled to the housing, the right cover side wall is laterally to the right of the right housing side wall, the left cover side wall is laterally to the left of the left housing side wall, and the top wall extends between the right cover side wall and the left cover side wall above the right housing side wall and the left housing side wall, each housing side wall having an edge, each housing side wall having an identical slotway extending laterally therethrough, each slotway extending from an opening where the slot is open through the edge of the respective housing side wall to a blind end, when the cover is coupled to the housing, the rod member extending laterally through both the right housing side wall and the left housing side wall by being located within each of the slotways, when the rod member is within the slotways, the slotways engaging the rod member and guiding relative sliding movement of the lower portion of the cover relative to the housing, wherein the rod member is slidable from the slotways through the openings to disengage the rod member from the slotways. Preferably, the cover when coupled to the housing is movable between a closed lower position in which the dispenser is operative for dispensing fluid and an open upper position in which access is provided to an interior of the housing, in moving between the closed lower position and the open upper position, the cover is guided by the rod member sliding within the slotways.

In a fourth aspect, the present invention provides a fluid dispenser having:

a housing, a cover assembly removably coupled to the housing, the cover having a right cover side wall and a left cover side wall secured together spaced laterally from each other and being a mirror image of each other, each cover side wall having an upper portion, a lower portion and an intermediate portion spanning between the upper portion and the lower portion, a top bridging member bridging between the upper portion of the right cover side wall and the upper portion of left cover side wall;

a bottom bridging member bridging between the lower portion of the right cover side wall and the lower portion of left cover side wall, the intermediate portion of the right cover side wall having a right latch member with a forwardly facing right latch surface, the intermediate portion of the left cover side wall having a left latch member with a forwardly facing left latch surface, the housing having on a right lateral side a right stop member carrying a rearwardly facing right stop surface, the housing having on a left lateral side a left stop member carrying a rearwardly facing left stop surface, the intermediate portion of the right cover side wall being resilient and having an inherent bias to adopt a right inherent condition, the intermediate portion of the right cover side wall being deflectable from the right inherent condition laterally toward the right to right deflected conditions in which the intermediate portion of the right cover side wall is laterally to the right of the right inherent condition, the intermediate portion of the left cover side wall being resilient and having an inherent bias to adopt a left inherent condition, the intermediate portion of the left cover side wall being deflectable from the left inherent condition laterally toward the left to left deflected conditions in which the intermediate portion of the left cover side wall is laterally to the left of the left inherent condition, when the cover is coupled to the housing with the intermediate portion of the right cover side wall in the right inherent condition and the intermediate portion of the left cover side wall in the left inherent condition, the right stop member of the housing interacts with the right latch member with engagement between the forwardly facing right latch surface and the rearwardly facing right stop surface and the left stop member of the housing interacts with the left latch member with engagement between the forwardly facing left latch surface and the rearwardly facing left stop surface preventing uncoupling of the cover from the housing by relative forward movement of the cover relative the housing, when the cover is coupled to the housing with the intermediate portion of the right cover side wall in the right inherent condition and the intermediate portion of the left cover side wall in the left inherent condition, with deflection of the right stop member of the housing to the right deflected condition and deflection of the left stop member of the housing to the left deflected condition, the right latch surface is moved sufficiently to the right to clear the right stop member and the left latch surface is moved sufficiently to the left to clear the left stop member that the cover can be moved forwardly relative the housing. Preferably, the top bridging member comprises a top wall. Preferably, the bottom bridging member comprises a rod member extending laterally between the right cover side wall and the cover left wall. Preferably, the housing has a right housing side wall and a left housing side wall, when the cover is coupled to the housing the right cover side wall is laterally to the right of right housing side wall, the left cover side wall is laterally to the left of housing side wall, and the top wall extends between the right cover side wall and the left cover side wall above the right housing side wall and the left housing side wall. Preferably, each housing side wall having an edge, each housing side wall having an identical slotway extending laterally therethrough, each slotway extending from an opening where the slotway is open through the edge of the respective housing side wall to a blind end, when the cover is coupled to the housing the rod member extending laterally through both the right housing side wall and the left housing side wall by being located within each of the slotways, when the rod member is within the slotways, the slotways engaging the rod member and guiding relative sliding movement of the lower portion of the cover relative to the housing. Preferably, the rod member is slidable from the slideways through the openings to disengage the rod member from the slotways.

The present invention provides various concepts including:

As concept 1, a fluid dispenser having:

a housing, a fluid pump, a cover assembly including a cover and a lever member, the lever member removably coupled to the cover, a cover assembly removably coupled to the housing for coupling and uncoupling of the cover assembly and the housing while the lever is coupled to the cover, when the cover assembly is coupled to the housing, the lever member is accessible for manual engagement by a user for movement of the lever to activate the fluid pump and dispense fluid from the fluid dispenser, the lever member including an axle about an axle axis, the cover having a right side wall and a left side wall secured together spaced laterally from each other and being a mirror image of each other, each side wall having an edge, each side wall having an identical axle keyway opening extending laterally therethrough, each axle keyway opening having an enlarged journaling bore and an entry/exit slot, each slot opens into the bore, extending from the bore to the edge of the respective side wall where the slot is open through the edge of the respective side wall, the cover about each slot being resilient and having an inherent bias to adopt an inherent configuration in which the slot is sized to retain the axle in the bore portion against removal, the cover about the slot being deflectable from the inherent configuration to deflected conditions which permit passage of the axle through the slot into or out of from the bore for uncoupling of the lever from the cover, when the lever member is coupled to the cover, the axle of the lever is received in the bore of each side wall journaled therein for rotation of the lever member about the axle axis relative the cover member.

As concept 2, a dispenser as in concept 1, wherein the edge of each side wall is a rearwardly directed rear edge.

As concept 3, a dispenser as in concepts 1 or 2 wherein each axle keyway opening is proximate an upper rear corner of each side wall.

As concept 4, a dispenser as in concepts 1, 2 or 3 wherein the axle has a left end and a right end, the axle extending laterally to the right through the bore in the right side wall to locate the right end exterior of the cover, the axle extending laterally to the left through the bore in the left side wall to locate the left end exterior of the cover.

As concept 5, a dispenser as in concept 4 wherein the lever having an exterior handle portion extending from the right end to the left end forwardly external of the cover to present an engagement portion for manual engagement by a user.

As concept 6, a dispenser as in concept 5 wherein the exterior handle portion comprises a U-shaped member with a forward bight forming the engagement portion, a right arm joining the right end of the axle and the bight and a left arm joining the left end of the axle and the bight.

As concept 7, a dispenser as in concept 6 wherein the cover defines an interior compartment between the right side wall and the left side wall, the lever having an interior handle portion within the interior compartment of the cover coupled to the axle, when the cover assembly is coupled to the housing, the interior handle portion is coupled to the fluid pump to activate the fluid pump with pivoting of the lever about the axle axis.

As concept 8, a dispenser as in concept 7 wherein the cover has a top wall bridging between the right side wall and the left side wall defining the interior compartment therebetween.

As concept 9, a dispenser as in concept 8 wherein:

the cover is open at a rear of the cover, the lever is removable from being coupled with the cover by rearward movement of the lever moving the axle rearwardly out of the keyhole openings through the rear edges of the side walls and moving the interior handle portion rearwardly within the interior compartment of the cover rearwardly out the open rear of the cover.

As concept 10, a dispenser as in concept 9 wherein the exterior handle portion comprises a U-shaped member with a forward bight forming the engagement portion, a right arm joining the right end of the axle and the bight and a left arm joining the left end of the axle and the bight.

As concept 11, a dispenser as in concept 10 wherein the right arm and the left arm are spaced laterally to permit the top wall and upper portions of the side walls to pass downwardly and/or forwardly therethrough for coupling and uncoupling of the cover and the lever.

As concept 12, a dispenser as in any one of concepts 1 to 11 wherein the axle is received coaxially within the bore against removal under forces less than a threshold force required to deflect the cover about each slot from the inherent configuration to deflected conditions which permit passage of the axle through each slot for removal of the axle from the cover.

As concept 13, a dispenser as in any one of concepts 1 to 12 wherein when the cover assembly is coupled to the housing in the closed position, the axle and its axle axis extend horizontally side to side across the housing and the cover assembly.

As concept 14, a dispenser as a fluid dispenser having:

a housing, a cover assembly removably coupled to the housing, the cover having a right cover side wall and a left cover side wall secured together spaced laterally from each other and being a mirror image of each other, each cover side wall having an upper portion, a lower portion and an intermediate portion spanning between the upper portion and the a lower portion, a top bridging member bridging between the upper portion of the right cover side wall and the upper portion of left cover side wall, a bottom bridging member bridging between the lower portion of the right cover side wall and the lower portion of left cover side wall, the intermediate portion of the right cover side wall having a right latch member with a forwardly facing right latch surface, the intermediate portion of the left cover side wall having a left latch member with a forwardly facing left latch surface, the housing having on a right lateral side a right stop member carrying a rearwardly facing right stop surface, the housing having on a left lateral side a left stop member carrying a rearwardly facing left stop surface, the intermediate portion of the right cover side wall being resilient and having an inherent bias to adopt a right inherent condition, the intermediate portion of the right cover side wall being deflectable from the right inherent condition laterally toward the right to right deflected conditions in which the intermediate portion of the right cover side wall is laterally to the right of the right inherent condition, the intermediate portion of the left cover side wall being resilient and having an inherent bias to adopt a left inherent condition, the intermediate portion of the left cover side wall being deflectable from the left inherent condition laterally toward the left to left deflected conditions in which the intermediate portion of the left cover side wall is laterally to the left of the left inherent condition, when the cover is coupled to the housing with the intermediate portion of the right cover side wall in the right inherent condition and the intermediate portion of the left cover side wall in the left inherent condition, the right stop member of the housing interacts with the right latch member with engagement between the forwardly facing right latch surface and the rearwardly facing right stop surface and the left stop member of the housing interacts with the left latch member with engagement between the forwardly facing left latch surface and the rearwardly facing left stop surface preventing uncoupling of the cover from the housing by relative forward movement of the cover relative the housing, when the cover is coupled to the housing with the intermediate portion of the right cover side wall in the right inherent condition and the intermediate portion of the left cover side wall in the left inherent condition, with deflection of the right stop member of the housing to the right deflected condition and deflection of the left stop member of the housing to the left deflected condition, the right latch surface is moved sufficiently to the right to clear the right stop member and the left latch surface is moved sufficiently to the left to clear the left stop member that the cover can be moved forwardly relative the housing.

As concept 15, a dispenser as in concept 14 wherein the top bridging member comprises a top wall.

As concept 16, a dispenser as in concept 14 or 15 wherein the bottom bridging member comprises a rod member extending laterally between the right cover side wall and the cover left wall.

As concept 17, a dispenser as in concept 16 wherein the housing has a right housing side wall and a left housing side wall, when the cover is coupled to the housing, the right cover side wall is laterally to the right of right housing side wall, the left cover side wall is laterally to the left of housing side wall, and the top wall extends between the right cover side wall and the left cover side wall above the right housing side wall and the left housing side wall.

As concept 18, a dispenser as in concept 17 wherein each housing side wall having an edge, each housing side wall having an identical slotway extending laterally therethrough, each slotway extending from an opening where the slotway is open through the edge of the respective housing side wall to a blind end, when the cover is coupled to the housing the rod member extending laterally through both the right housing side wall and the left housing side wall by being located within each of the slotways, when the rod member is within the slotways, the slotways engaging the rod member and guiding relative sliding movement of the lower portion of the cover relative to the housing.

As concept 19, a dispenser as in concept 18 wherein the rod member is slidable from the slideways through the openings to disengage the rod member from the slotways.

As concept 20, a dispenser as in concept 19 wherein the cover when coupled to the housing is movable between a closed lower position in which the dispenser is operative for dispensing fluid and an open upper position in which access is provided to an interior of the housing, in moving between the closed lower position and the open upper position, the cover is guided by the rod member sliding within the slotways.

As concept 21, a dispenser as in concept 20 including a spring biasing the cover upwardly relative the housing to the open upper position.

As concept 22, a dispenser as in concept 20 or 21 wherein, when the cover is coupled to the housing, is in the open upper position with the intermediate portion of the right cover side wall in the right inherent condition and the intermediate portion of the left cover side wall in the left inherent condition, with deflection of the right stop member of the housing to the right deflected condition and deflection of the left stop member of the housing to the left deflected condition so that the right latch surface is moved sufficiently to the right to clear the right stop member and the left latch surface is moved sufficiently to the left to clear the left stop member, then the cover can be moved forwardly relative the housing and the cover is pivotable about the rod member in the slotways to move the upper portion of the cover forwardly and downwardly with the top wall to clear the housing and the cover is then movable relative the housing to slide the rod member from the slotways through the openings to disengage the rod member from the slotways.

As concept 23, a dispenser as in any one of concepts 20 to 22 wherein the edge of each housing side wall is a downwardly directed bottom edge.

As concept 24, a dispenser as in any one of concepts 20 to 23 wherein each slotway extends from the opening upwardly to the blind end.

As concept 25, a dispenser as in concept 24 wherein, in moving the cover relative the housing between the closed lower position and the open upper position, the rod member slides upwardly within the slotways with the rod member engaging the blind ends to stop upward movement of the cover relative the housing in the open upper position.

As concept 26, a dispenser as in concept 25 wherein, in the closed lower position, the rod member is engaged within the slotways in a position intermediate the blind ends and the openings to the slotways.

As concept 27, a fluid dispenser having:

a housing, a cover assembly removably coupled to the housing, the cover having a right cover side wall and a left cover side wall secured together spaced laterally from each other and being a mirror image of each other, each cover side wall having an upper portion, a lower portion and an intermediate portion spanning between the upper portion and the lower portion, a top bridging member bridging between the upper portion of the right cover side wall and the upper portion of left cover side wall, the top bridging member comprising a top wall, a bottom bridging member bridging between the lower portion of the right cover side wall and the lower portion of left cover side wall, the bottom bridging member comprising a rod member extending laterally between the right cover side wall and the cover left wall, the housing has a right housing side wall and a left housing side wall, when the cover is coupled to the housing, the right cover side wall is laterally to the right of right housing side wall, the left cover side wall is laterally to the left of the left housing side wall, and the top wall extends between the right cover side wall and the left cover side wall above the right housing side wall and the left housing side wall, each housing side wall having an edge, each housing side wall having an identical slotway extending laterally therethrough, each slotway extending from an opening where the slot is open through the edge of the respective housing side wall to a blind end, when the cover is coupled to the housing the rod member extending laterally through both the right housing side wall and the left housing side wall by being located within each of the slotways, when the rod member is within the slotways, the slotways engaging the rod member and guiding relative sliding movement of the lower portion of the cover relative to the housing, wherein the rod member is slidable from the slideways through the openings to disengage the rod member from the slotways.

As concept 28, a dispenser as in concept 27 wherein the cover when coupled to the housing is movable between a closed lower position in which the dispenser is operative for dispensing fluid and an open upper position in which access is provided to an interior of the housing, in moving between the closed lower position and the open upper position, the cover is guided by the rod member sliding within the slotways.

As concept 29, a fluid dispenser having:

a housing, a cover assembly coupled to the housing for movement between a closed lower position in which the dispenser is operative for dispensing fluid and an open upper position in which access is provided to an interior of the housing, the cover assembly including a cover and a lever member, the lever member including an axle portion with an axle axis, the lever member removably coupled to the cover for pivoting of the lever member relative the cover about axle axis, the cover having a keyway axle slot with an enlarged circular portion enclosed but for being open to a rear edge of the cover as a slot way of reduced width compared to a diameter of the circular portion, the axle portion received coaxially within the axle slot against removal under forces less than a threshold force required to move the axle from the circular portion through the slot way by resilient deflection of the cover about the slotway, when the cover assembly is coupled to the housing in the closed lower position, the axle member and its axle axis extend horizontally side to side across the housing and the cover assembly.

As concept 30, a dispenser as in concept 29 wherein:

the housing having a releasable cover latching mechanism, the latching mechanism including a rearwardly extending hook member, the hook member removably engaging the axle member when the cover assembly is in the closed lower position to prevent movement of the cover assembly from the closed lower position to the upper open position.

As concept 31, a dispenser as in concept 30 wherein the hook member movably mounted to the housing for movement between a latched position in which the hook member engages the axle member when the cover assembly is in the closed lower position to prevent movement of the cover assembly relative the housing from the closed lower position to the upper open position, and an unlatched position in which the hook member is disengaged from the axle member and the cover assembly is movable between the closed lower position and the upper open position.

As concept 32, a dispenser as in concept 31 wherein the latching mechanism includes a latch engagement member for engagement by a user to move the hook member between the latched position and the unlatched position.

As concept 33, a dispenser as in concept 32 wherein the latching mechanism includes a spring mechanism to urge the hook member to the latched position relative the housing when the hook member is moved away from the latched position toward the unlatched position.

As concept 34, a dispenser as in concept 33 wherein the housing has a forward opening providing access to the interior of the housing, the cover covers an upper portion of the forward opening of the housing in the closed upper position.

As concept 35, a dispenser as in concept 34 including a pump mechanism within the interior of the housing, when the cover assembly is coupled to the housing in the closed lower position, pivoting of the lever member relative the cover about axle axis activating the pump mechanism to discharge a fluid.

As concept 36, a dispenser as in concept 35 wherein the pump mechanism has a dispensing nozzle which extends forwardly beyond the housing for dispensing the fluid downwardly, the cover including a shroud portion overlying the nozzle and at least partially protecting the nozzle from engagement by a user when the cover is in the closed position.

As concept 37, a dispenser as in concept 36 wherein:

the pump mechanism is coupled to the housing for removal when the cover is in the open position, and prevented from removal when the cover is in the closed position.

As concept 38, a dispenser as in concept 37 including a fluid reservoir within the interior of the housing from which fluid is to be dispensed, the reservoir coupled to the pump mechanism with the pump mechanism and reservoir being removable as a unit from the interior for replacement when the cover is in the open position.

As concept 39, a dispenser as in concept 38 wherein the housing carries in the interior a support plate for supporting the pump mechanism.

As concept 40, a fluid dispenser having:

a housing, a cover assembly removably coupled to the housing for coupling and uncoupling of the cover assembly and the housing, when the cover is coupled to the housing, the cover and housing define an interior compartment therebetween, the cover having a right cover side wall and a left cover side wall secured together spaced laterally from each other, the housing has a right housing side wall and a left housing side wall secured together spaced laterally from each other by a housing back wall, when the cover is coupled to the housing, the right cover side wall is laterally to the right of right housing side wall, the left cover side wall is laterally to the left of the left housing side wall, when the cover is coupled to the housing, the right cover side wall engages the right housing side wall and the left cover side wall engages the left housing side wall, to uncouple the cover from the housing, the right cover side wall is deflected laterally away from the right housing side wall and the left cover side wall is deflected laterally away from the left housing side wall.

As concept 41, a fluid dispenser as in concept 40 wherein the cover has a top wall bridging between the right side wall and the left side wall and the top wall extends between the right cover side wall and the left cover side wall above the right housing side wall and the left housing side wall.

As concept 42, a fluid dispenser as in concept 40 or 41 wherein the cover is open at a rear of the cover, in coupling of the cover assembly and the housing while the right cover side wall is deflected laterally away from the right housing side wall and the left cover side wall is deflected laterally away from the left housing side wall, the housing passes rearwardly through the open rear of the cover, and in uncoupling of the cover assembly and the housing while the right cover side wall is deflected laterally away from the right housing side wall and the left cover side wall is deflected laterally away from the left housing side wall, the housing passes forwardly through the open rear of the cover.

As concept 43, a fluid dispenser having a housing and a cover removably coupled to the housing with the cover having a right cover side wall and a left cover side wall secured together spaced laterally from each other and in which the cover side walls are resilient and deflectable laterally away from each other for disengagement of the cover from the housing.

As concept 44, a fluid dispenser having a cover including a right cover side wall and a left cover side wall spaced laterally from each other and joined by a top wall and in which a rod member bridges between lower portions of the side walls.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
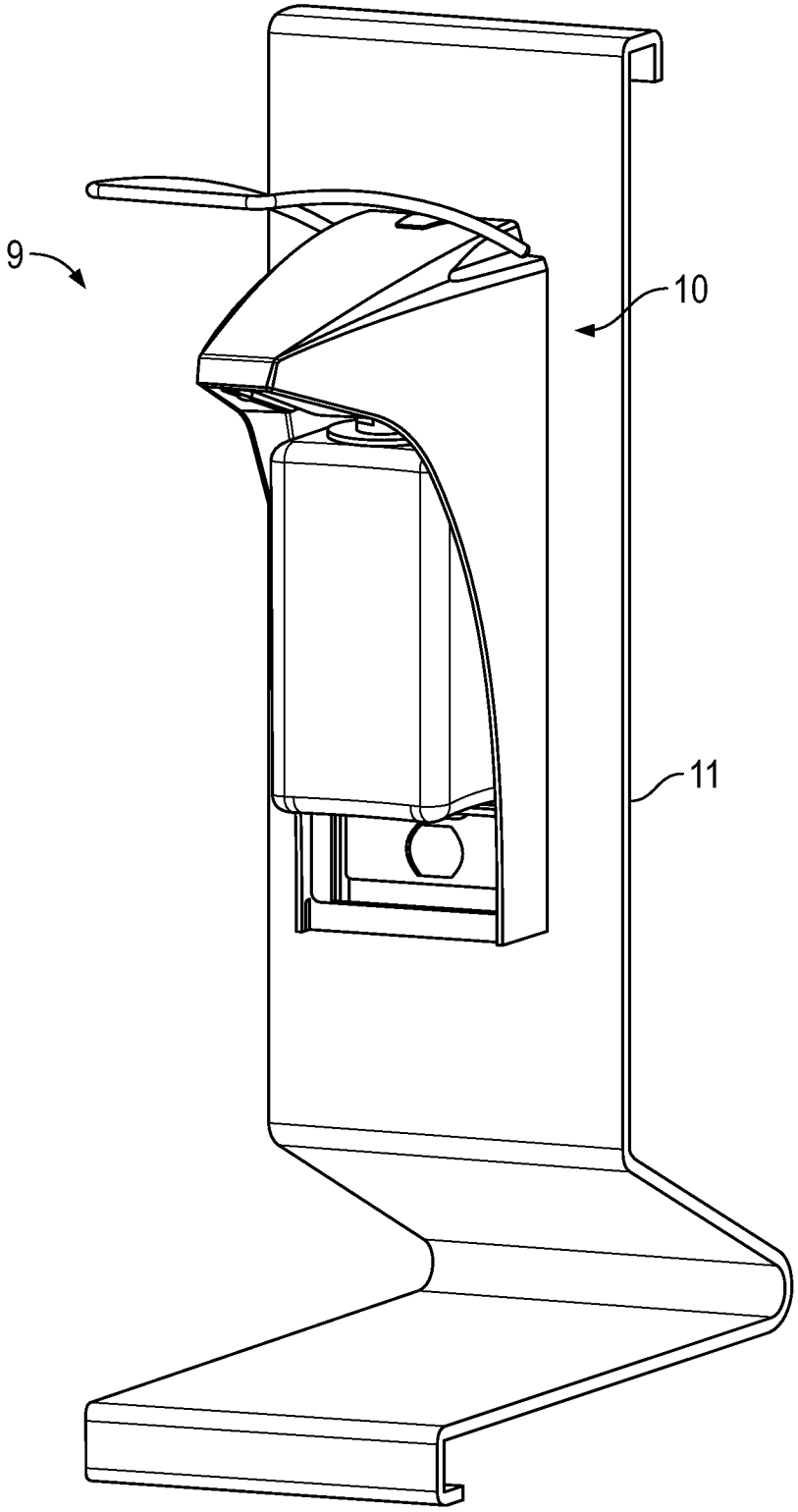
FIG. 1 is a pictorial view of a fluid dispenser in accordance with a first embodiment of the present invention in an operative position and mounted to a stand.
Figure 2:
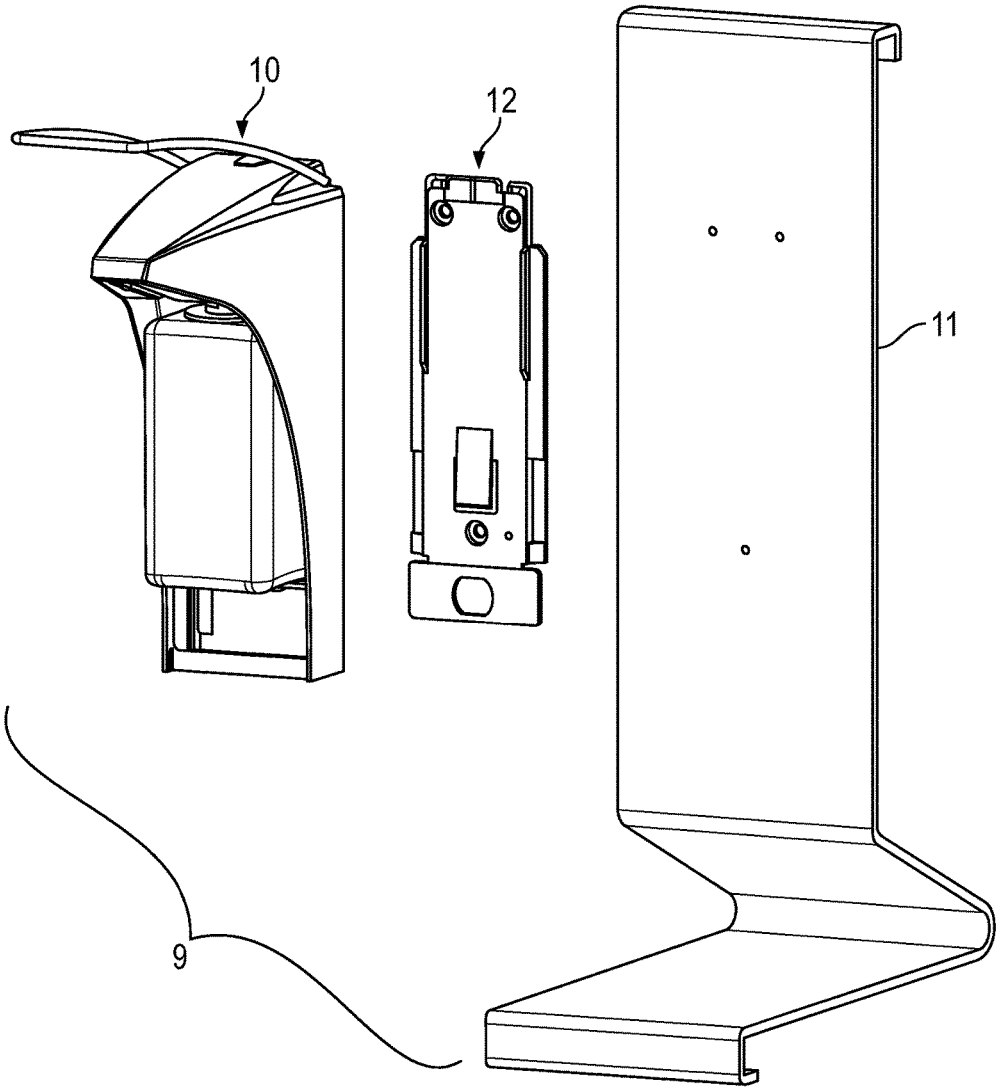
FIG. 2 is a partially exploded pictorial view of FIG. 1 showing a dispenser assembly, a mounting plate and the stand separately.

Reference is made to FIGS. 1 and 2 which illustrate a dispenser 9 in accordance with the present invention including a dispenser assembly 10 mounted to a vertical face of a stand 11. As seen in FIG. 2, the dispenser 9 includes a backplate 12 to be secured to the stand 11 and the dispenser assembly 10 is removably secured to the backplate 12.

Figure 6:
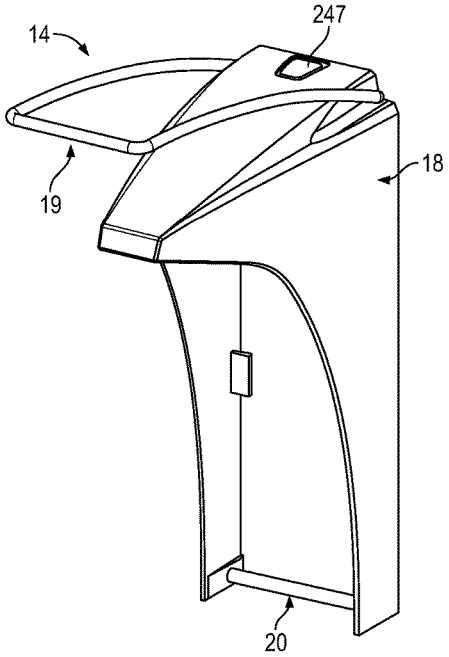
FIG. 6 is a pictorial view of a cover assembly of the dispenser assembly of FIG. 2.
Figure 7:
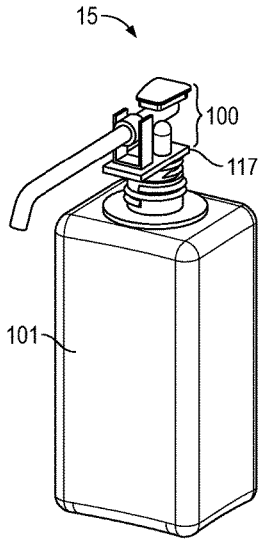
FIG. 7 is a pictorial view of a removable cartridge comprising a pump mechanism and a bottle of the dispenser assembly of FIG. 2.
Figure 8:
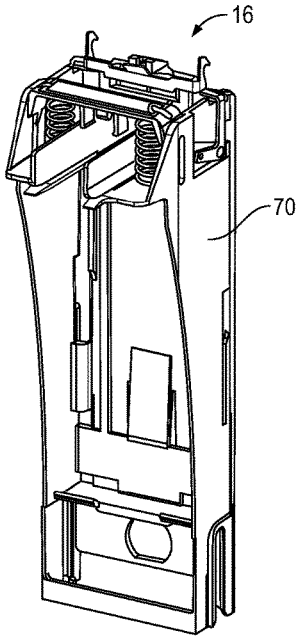
FIG. 8 is a pictorial view of a housing assembly of the dispenser assembly of FIG. 2 as mounted on the mounting plate.

The dispenser assembly 10 contains three principal components, namely, a cover assembly 14 as shown in FIG. 6, a cartridge 15 as shown in FIG. 7 and a housing assembly 16 as shown in FIG. 8.

Figure 9:
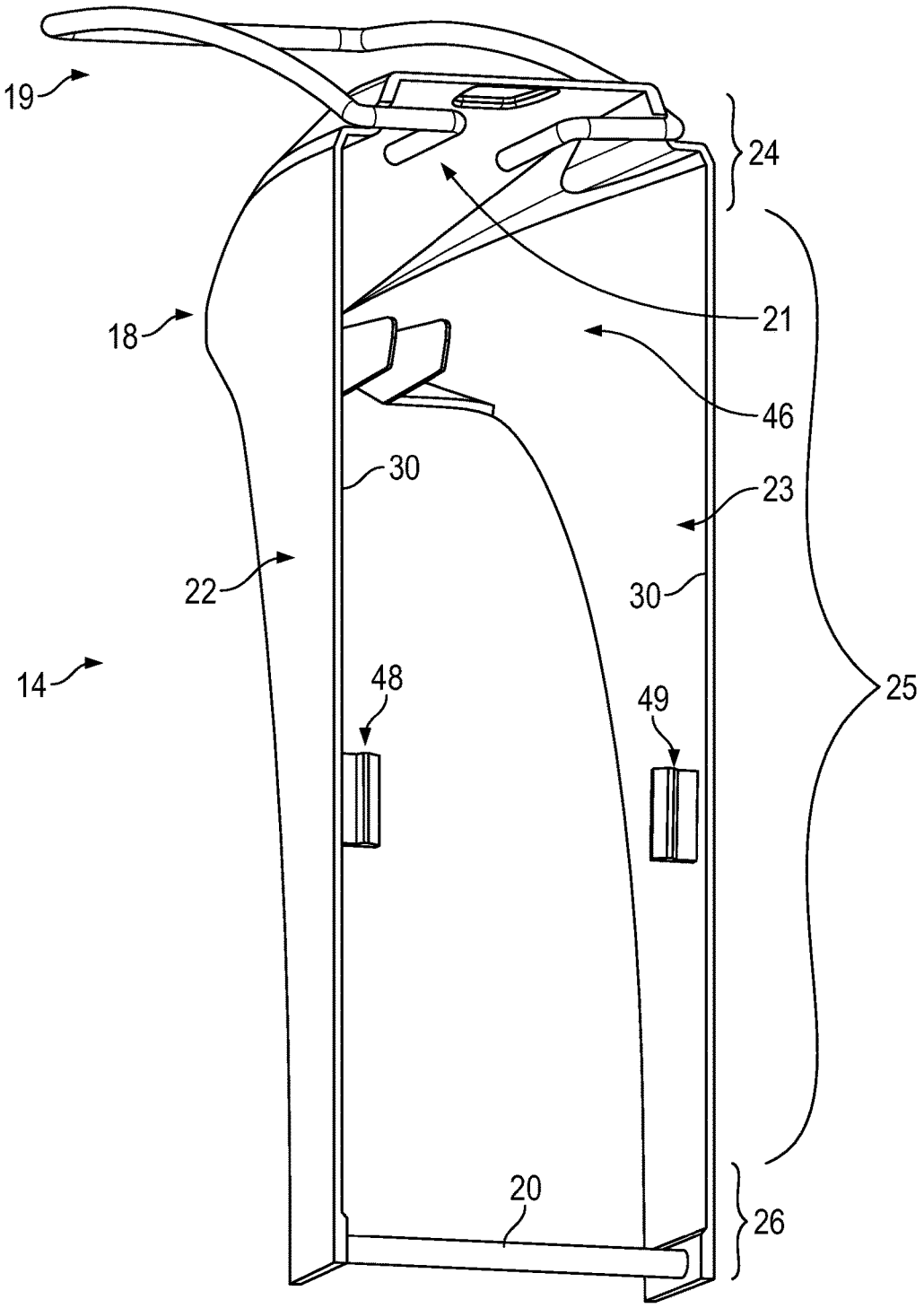
FIG. 9 is a rear pictorial view of the cover assembly of FIG. 6.

As seen in FIGS. 6 and 9, the cover assembly 14 includes a cover 18, a lever 19 and a rod member 20. Referring to FIG. 9, the cover 18 includes a top wall 21, a right cover side wall 22 and a left cover side wall 23. The right cover side wall 22 and the left cover side wall 23 are secured together spaced laterally from each other by being connected at an upper end by the top wall 21 and a lower end by the rod member 20. The rod member 20 is preferably a cylindrical member bridging between the side walls 22 and 23 and each end of the rod member 20 is fixedly secured within a blind bore in a lower portion 26 of each of the side walls 22 and 23. In the preferred embodiment, the cover assembly 14 including the cover 18 and the lever 19 is each symmetrical about a central longitudinal plane along section line A-A' in FIG. 3. Each of the side walls 22 and 23 has a top portion 24 and a lower portion 26 with an intermediate portion 25 bridging between the top portion 24 and the lower portion 26.

Figure 11:
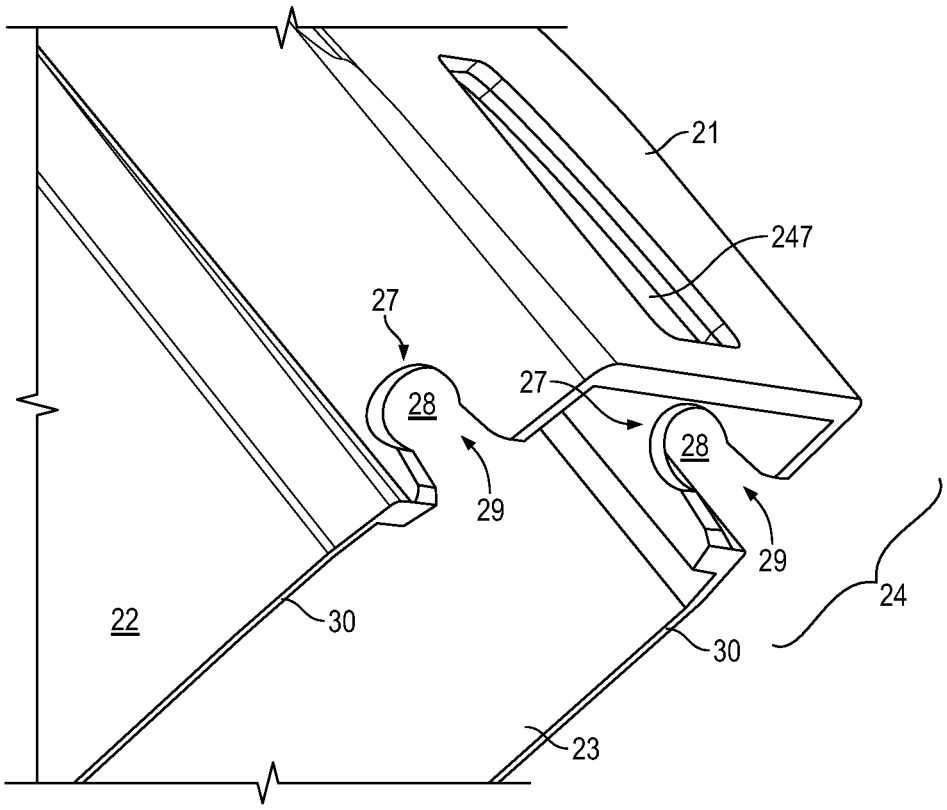
FIG. 11 is a rear pictorial view of an upper rear portion of the cover of FIG. 10.

As best seen in FIG. 11, in the top portion 24 of each of the side walls 22 and 23, there is provided an identical axle keyway opening 27 that extends laterally through the respective side wall 22 and 23. Each axle keyway opening 27 has an enlarged journaling bore 28 and entry/exit slot 29. Each slot 29 is open into the bore 28, extends from the bore 28 to a rear edge 30 of each of the side walls 22 and 23 where each slot 29 is open through the edge 30.

Figure 12:
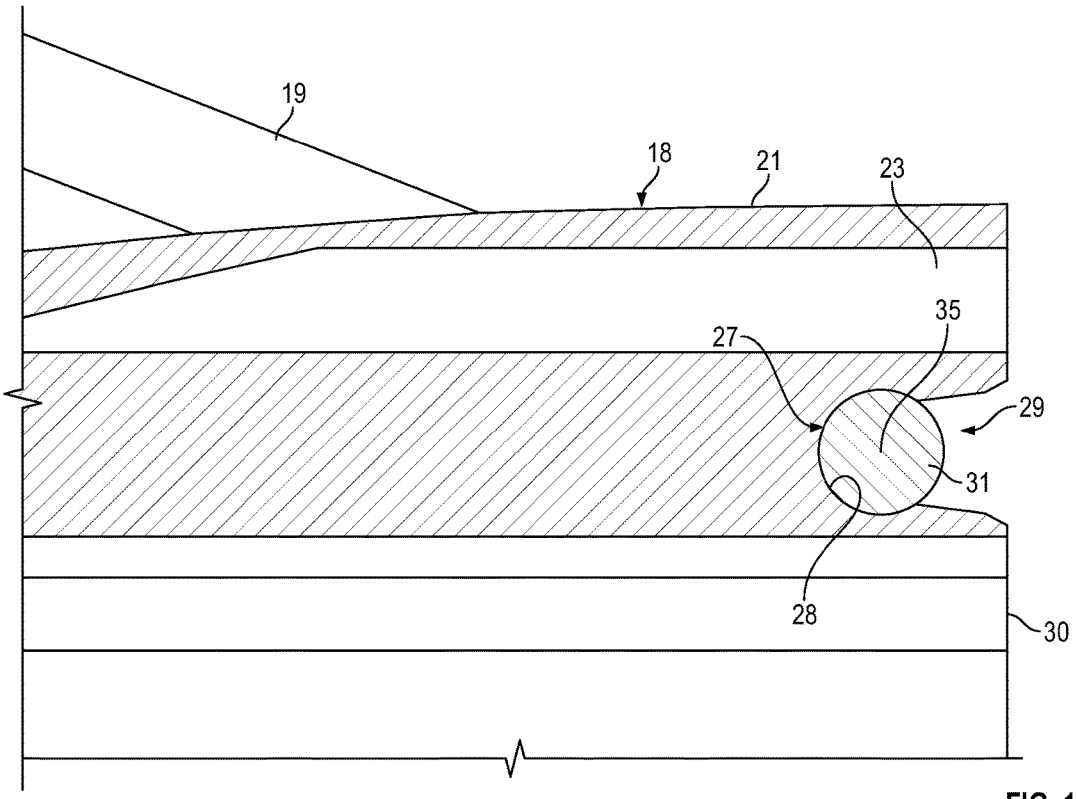
FIG. 12 is a right side view of an upper rear portion of the cover assembly of FIG. 6.

The cover 18 about each slot 29 is resilient and has an inherent bias to adopt an inherent configuration as shown in FIGS. 11 and 12. The cover 18 about each slot 29 is deflectable from the inherent configuration to deflected conditions in which the slots 29 increase in width to permit the coupling and uncoupling of the lever 19 with the cover 18.

Figure 10:
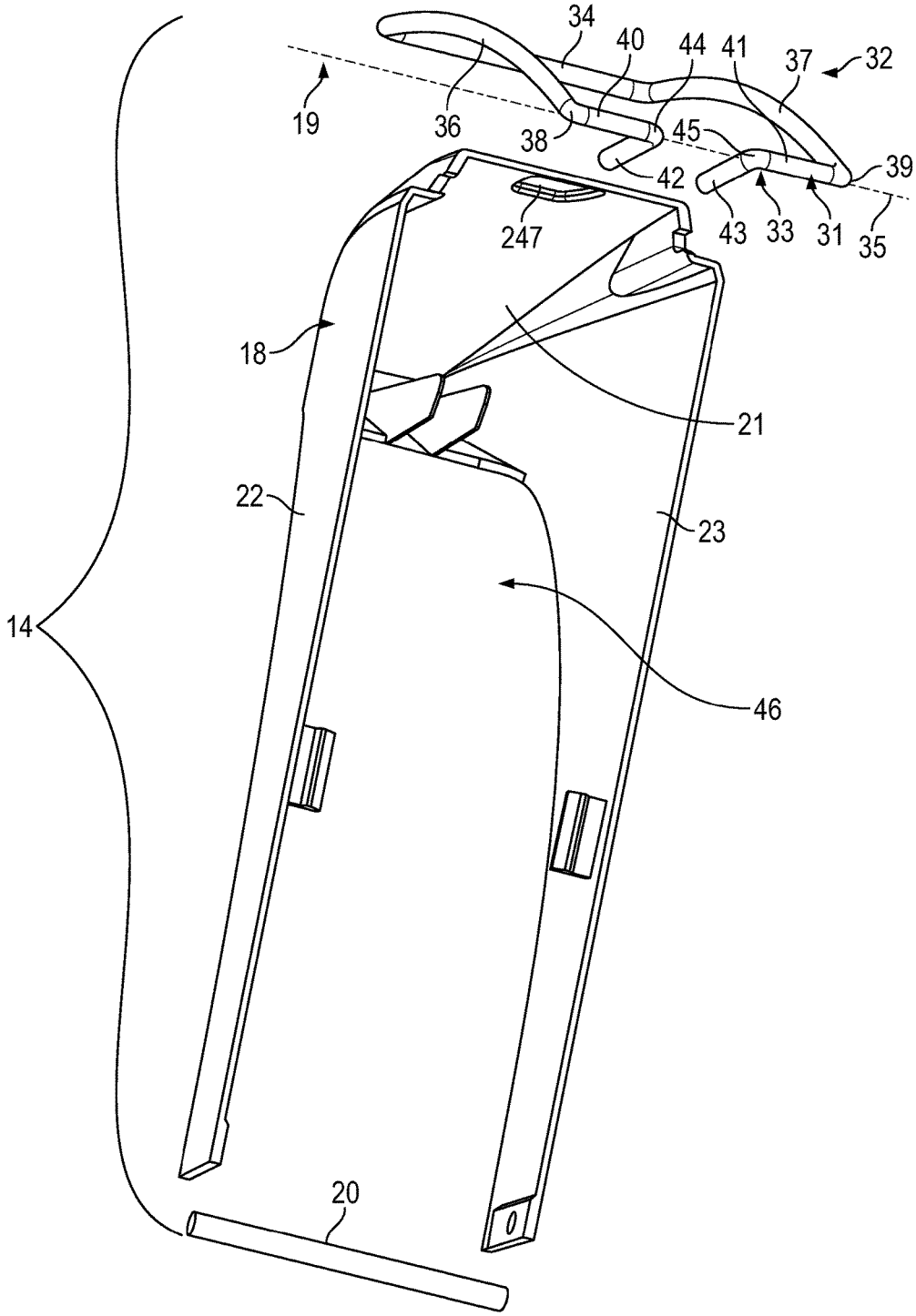
FIG. 10 is a rear exploded pictorial view of a cover and a lever of the cover assembly of FIG. 6.

Referring to FIG. 10, the lever 19 has an exterior handle portion 32, an axle 31 and an interior actuator portion 33. The exterior handle portion 32 comprises a U-shaped member with a forward bight 34 which merges rearwardly into a right arm 36 and a left arm 37. The right arm 36 is connected at its rear to an outer right end 38 of a right segment 40 of the axle 31. The left arm 37 extends rearwardly to join with an outer left end 39 of a left segment 41 of the axle 31. The axle 31 including both the right segment 40 and the left segment 41 is coaxial about an axle axis 35. The interior actuator portion 33 includes a right activator rod 42 which extends forwardly from an inner right end 44 of the right segment 40 of the axle 31. The interior actuator portion 33 includes a left activator rod 43 which extends forwardly from an inner left end 45 of the left segment 41 of the axle 31. The right activator rod 42 and the left activator rod 43 are disposed in the same plane.

The lever 19 is removably coupled to the cover 18 by reason of the axle 31 of the lever 19 being removably coupled within the axle keyway openings 27 in the side walls 22 and 23. The bore 28 of each keyway opening 27 is sized to receive the axle 31 of the lever 19 therein and journal the lever 19 for rotation of the lever 19 about the axle axis 35 relative the cover 18. The right segment 40 of the axle 31 is received within the bore 28 of the keyway opening 27 of the right cover side wall 22 and the left segment 41 of the axle 31 is received within the bore 28 of the keyway opening 27 of the left cover side wall 23.

The axle 31 is removably received within the bores 28 in a snap-fit. The cover 18 about each slot 29 is resilient with its inherent bias adopting the inherent configuration as seen in FIGS. 11 and 12 in which the slot 29 is sized to retain the axle 31 in the bore 29 against removal. The cover 18 about the slot 29 is deflectable from the inherent configuration to deflected conditions which permit passage of the axle 31 through the slot 29 either into or out from the bore 29 for coupling and uncoupling of the lever 19 and the cover 18. The axle 31 is received coaxially within the bores 28 of the keyway openings 27 against removal under forces less than a threshold force required to deflect the cover 18 about each slot 29 from the inherent condition to deflected conditions which permit passage of the axle 31 through each slot 29 for removal of the axle 31 from the keyway openings 27 of the cover 18. The cover assembly 14 is removably coupled to the housing assembly 16 for coupling and uncoupling of the cover assembly 14 to the housing assembly 16 while the lever 19 is coupled to the cover 18. After the cover assembly 14 is uncoupled from the housing assembly 16, the lever 19 and the cover 18 may be disengaged and separated from each other by removing the axle 31 from the keyway openings 27.

The cover 18 defines an interior compartment 46 between the right cover side wall 22 and the left cover side wall 23. When the lever 19 is coupled to the cover 18 with the axle 31 journalled in keyway openings 27, the interior actuator portion 33 is within the interior compartment 46 coupled to the axle 31 and the exterior handle portion 32 extends forwardly exterior of the interior compartment 46. The lever 19 is removable from being coupled with the cover 18 by rearward movement of the lever 19 moving the axle 31 rearwardly out of the keyway openings 27 through the rear edges 30 of the side walls 22 and 23, moving the interior actuator portion 33 rearwardly from within the interior compartment 46 out the open rear of the cover 18. The right arm 36 and the left arm 37 of the exterior handle portion 32 are spaced laterally so as to permit the top wall 21 and top portions 24 of the side walls 22 and 23 of the cover 18 to pass downwardly and forwardly between the right arm 36 and the left arm 37 to assist coupling and uncoupling of the lever 19 with the cover 18. In the preferred embodiment, as shown in FIG. 10, the cover 18 is open at a rear of the cover and the keyway openings 27 are open to the rear edge 30 of the cover 18.

Figure 13:
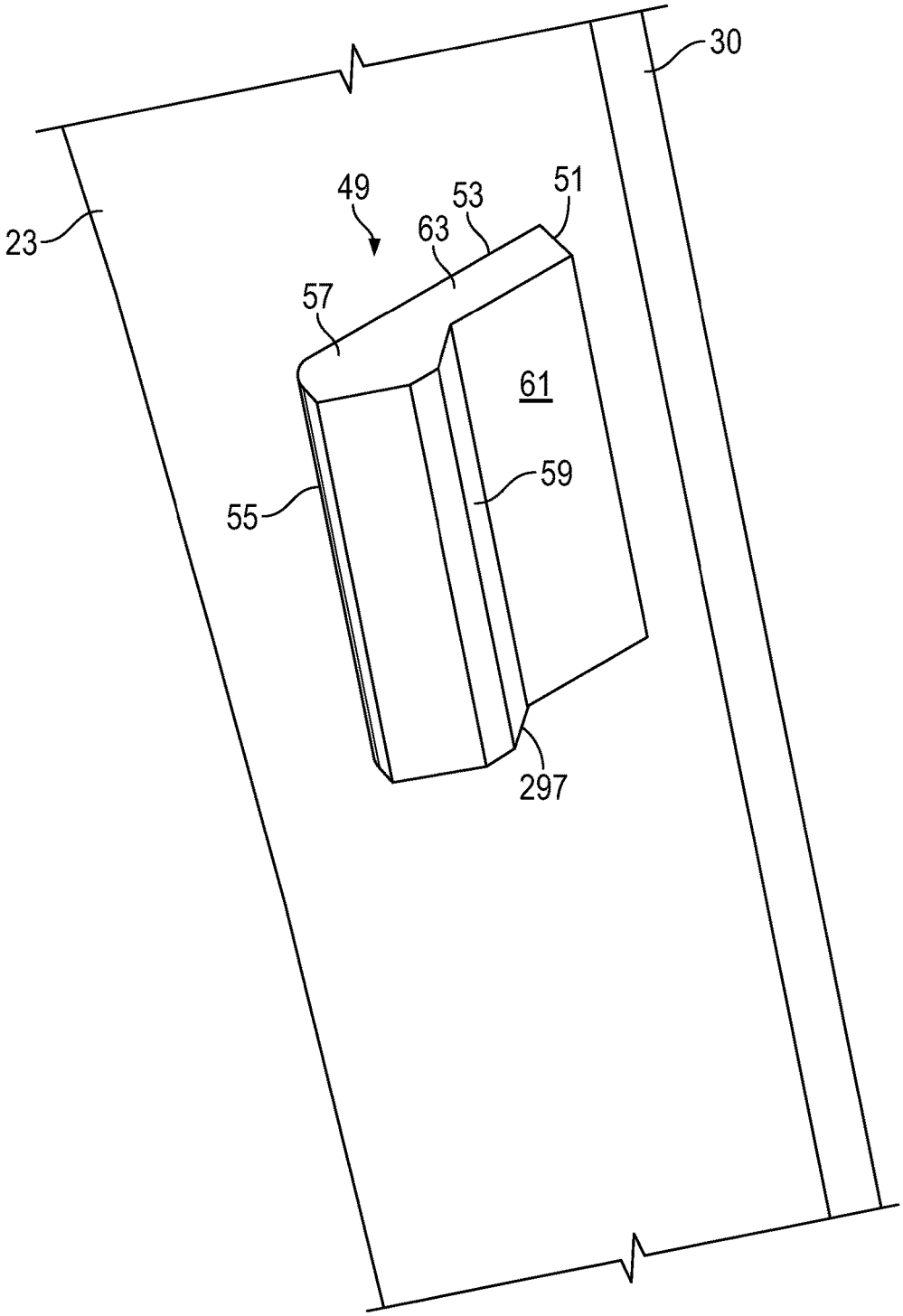
FIG. 13 is a rear pictorial view of a left latch member on a left cover side wall of the cover of FIG. 10 as viewed downwardly and from above.
Figure 30:
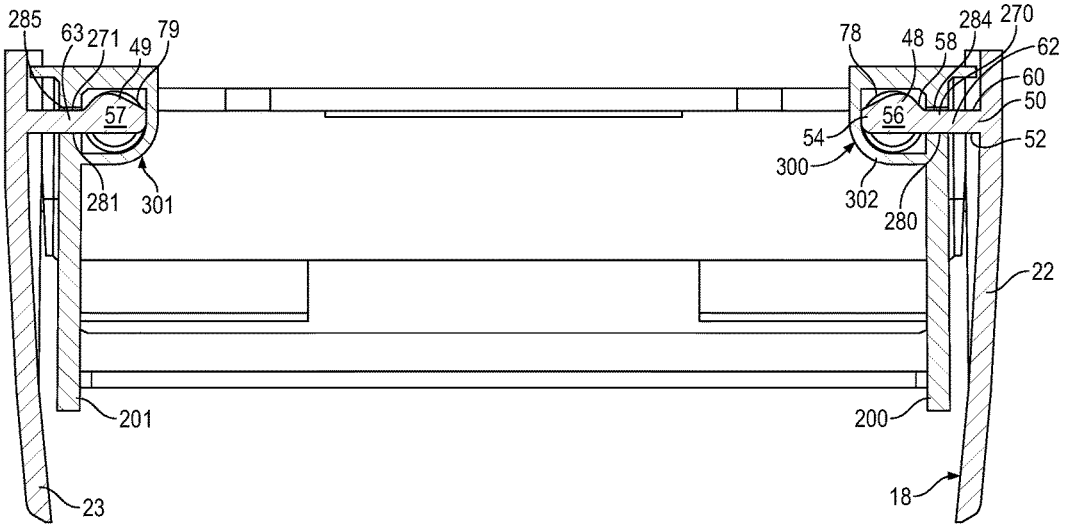
FIG. 30 is a cross-sectional top view along section line E-E in FIG. 28.

Referring to FIGS. 9 and 13, on the intermediate portion 25 of the right cover side wall 22, there is provided a right latch member 48 and on the intermediate portion 25 of the left cover side wall 23, there is provided a left latch member 49. Each of these latch members 48 and 49 extend laterally inwardly. The left latch member 49 is fixedly secured at a laterally outer end 51 to the left cover side wall 23 and extends laterally inwardly from the outer end 51 laterally inwardly to a distal inner end 55 formed as an enlarged bulbous portion 57 which presents a laterally outward facing side surface 59 merging into a rearwardly facing latch surface 61. The left latch member 49 has a forward facing latch surface 53. A reduced thickness portion 63 is defined between the forwardly facing latch surface 53 and the rearwardly facing latch surface 61. Similarly, as seen in FIG. 30, the right latch member 48 is fixedly secured at a laterally outer end 50 to the right cover side wall 22 and extends laterally inwardly from the outer end 50 laterally inwardly to a distal inner end 54 formed as an enlarged bulbous portion 56 which presents a laterally outward facing side surface 58 merging into a rearwardly facing latch surface 60. The right latch member 48 has a forward facing latch surface 52. A reduced thickness portion 62 is defined between the forwardly facing latch surface 52 and the rearwardly facing latch surface 60.

Figure 14:
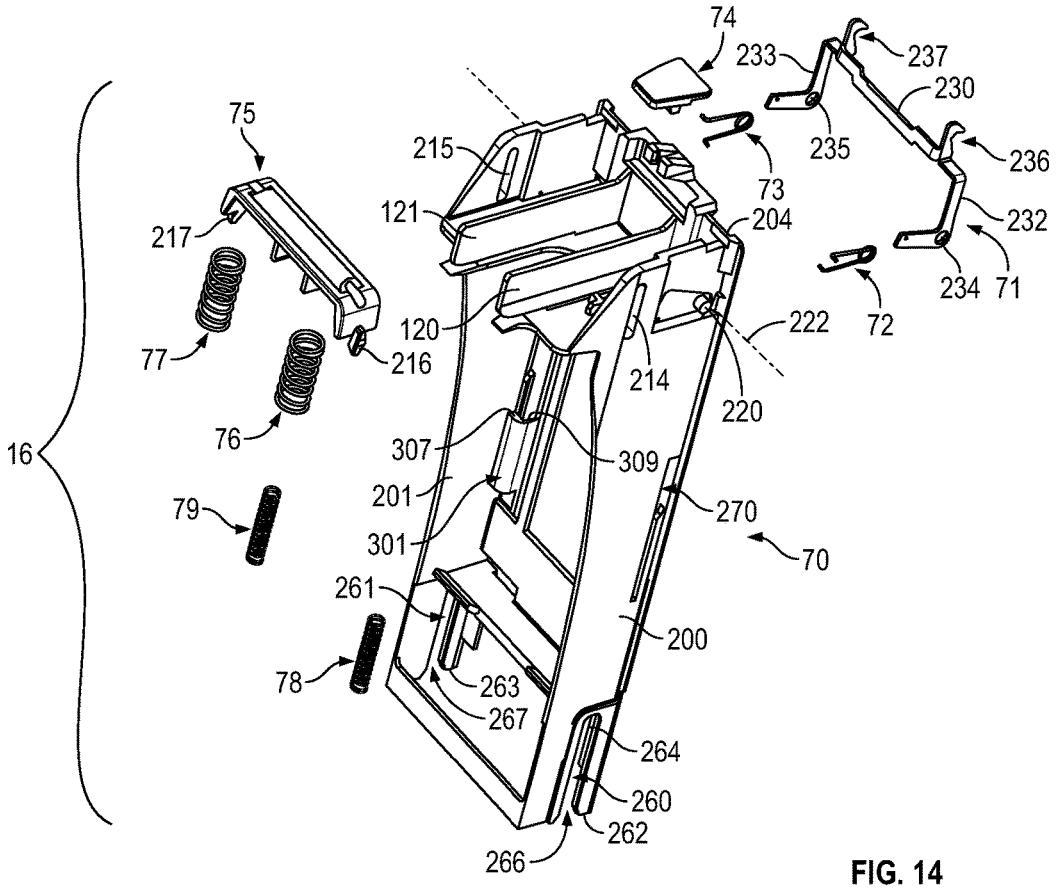
FIG. 14 is an exploded pictorial view of the housing assembly of FIG. 8 as viewed looking rearwardly and downwardly.
Figure 15:
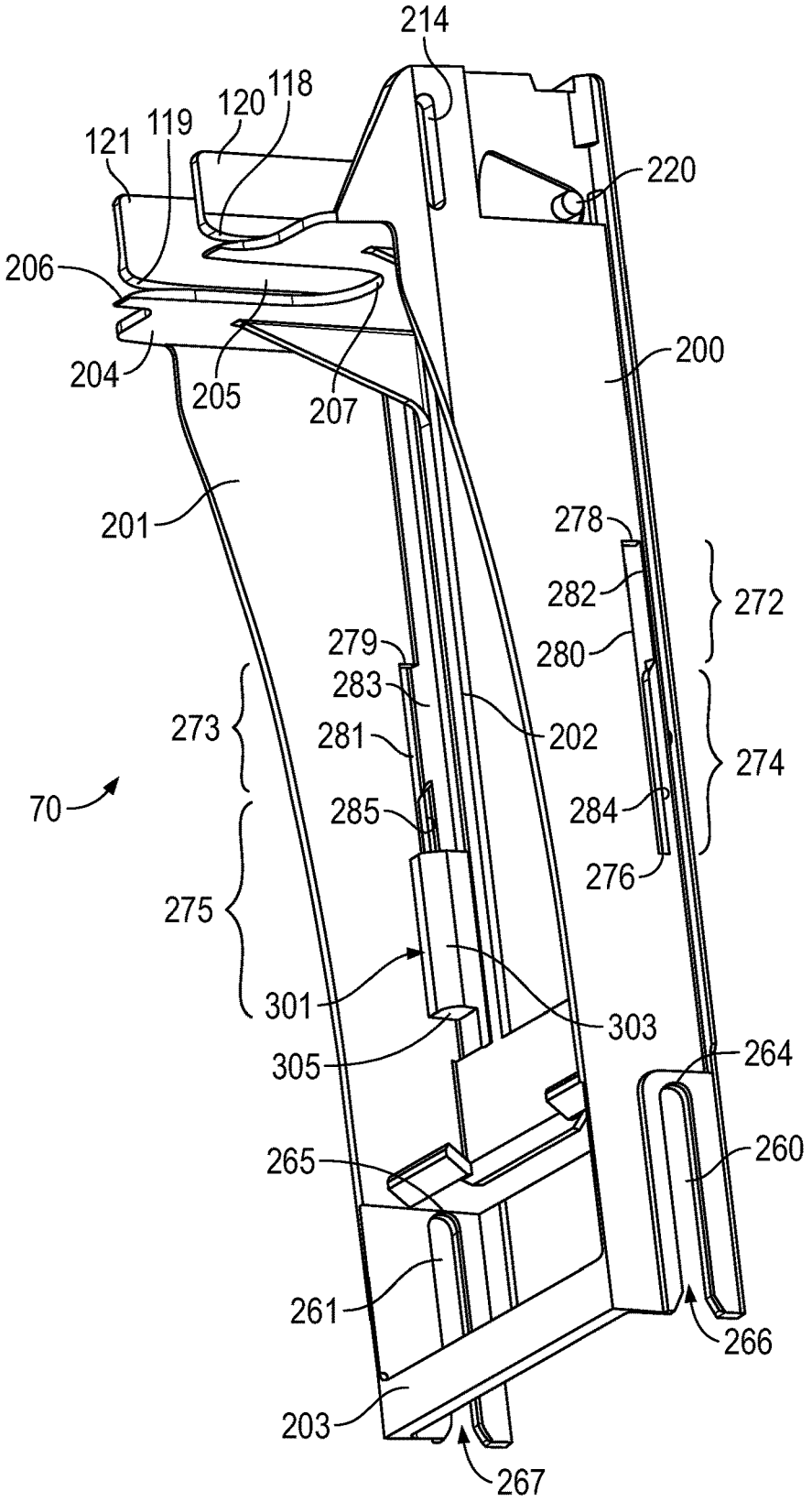
FIG. 15 is a pictorial view of a housing from FIG. 14 as viewed looking rearwardly and upwardly.

Reference is made to FIGS. 8, 14 and 15. FIG. 8 shows the housing assembly 16 in an assembled condition. FIG. 14 shows the housing assembly 16 in an exploded condition. As seen in FIG. 14, the housing assembly 16 includes a housing 70, a hook bracket 71, a pair of right and left hook springs 72 and 73, a latch engagement member or button 74, a pump actuator plate 75, a pair of right and left plate springs 76 and 77 and a pair of right and left cover lift springs 78 and 79.

The housing 70 has a housing right side wall 200 and a housing left side wall 201 which are fixedly secured together as joined by a partial back wall 202 and a partial front wall 203, each of which bridges between the housing side walls 200 and 201. Proximate an upper end of the housing side wall, a horizontal support flange 204 extends horizontally between the housing side walls and is secured to the back wall 202. A slot 205 extends from an opening in a front edge 206 of the support flange 204 rearwardly to a blind rear end 207. A pair of left and right vertical guide walls 120 and 121 extend forwardly from the back wall 202 on either side of the slot 205. Forward from the end 207 of the slot 205, horizontally extending channelways 118 and 119 separate each of the vertical guiding walls 120 and 121 from the support flange 204. The housing right and left side walls 200 and 201 carry vertically extending channels 214 and 215 which are to receive laterally extending left and right slide members 216 and 217 on the pump actuator plate 75 so as to couple the pump actuator plate 75 to the housing 70 for relative vertical sliding. The right and left plate springs 76 and 77 are disposed between the support flange 204 and the pump actuator plate 75 to bias the pump actuator plate 75 to an upper position in the channels 214 and 215 and to permit but resist downward movement of the actuator plate 75 to lower positions within the channels 214 and 215.

Proximate the upper rear, each of the housing right side wall 200 and the housing left side wall 201 carry respective right and left stub axles 220 and 221 that extend laterally outwardly. The hook bracket 71 includes a central bridge member 230 which joins a right side arm 232 to a left side arm 233. The right side arm 232 has a bore 234 laterally therethrough to be engaged on the right stub axle 220 and the left side arm 233 has a bore 235 to engage on the left stub axle 221 so as to mount the hook bracket 71 to the housing 70 for pivoting about a horizontal hook axis 222 coaxial of the stub axles 220 and 221. The right hook spring 72 is disposed between the housing 70 and the right side arm 232 to bias the bridge member 230 rearwardly. Similarly, the left hook spring 73 is disposed between the housing 70 and the left side arm 233 to bias the bridge member 230 rearwardly. The bridge member 230 carries a right hook 236 and a left hook 237.

Figure 17:
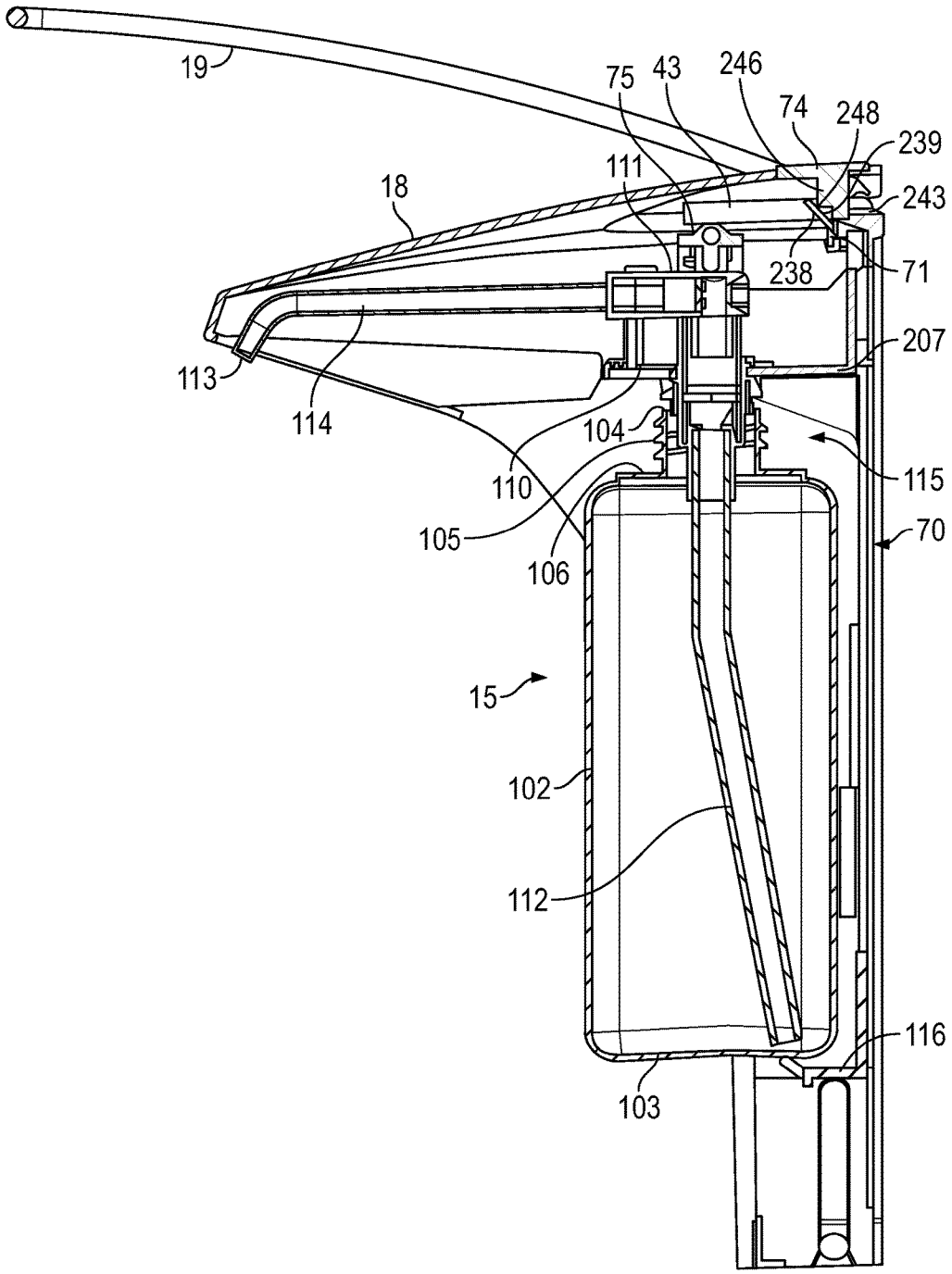
FIG. 17 is a cross-sectional right side view of the dispenser assembly of FIG. 3 along section line A-A' in FIG. 3.
Figure 21:
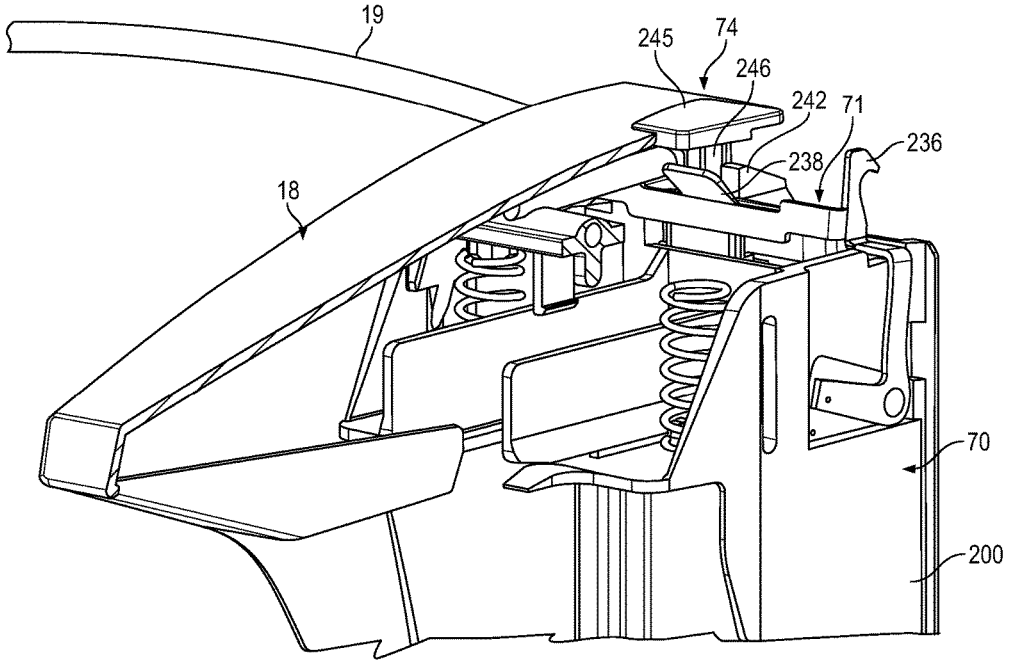
FIG. 21 is a partial pictorial view similar to FIG. 16, however, with the cartridge assembly removed and with the cover assembly shown cross-sectioned along section line A-A' in FIG. 3.

As seen in pictorial view in FIG. 21 and in side view in FIG. 17, the bridge member 330 of the hook bracket 71 carries a cam plate 238 with an upwardly directed cam surface 239 that extends at an angle upwardly and forwardly away from the bridge member 230.

Figure 4:
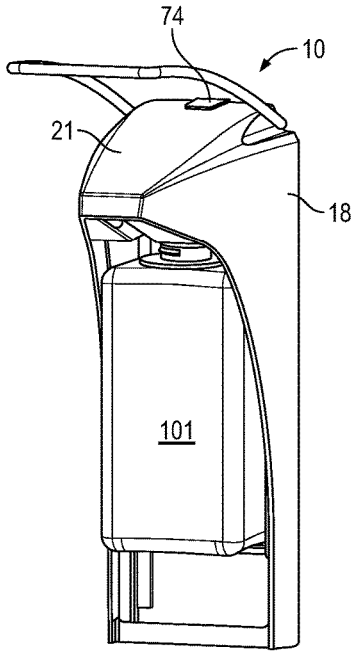
Figure 5:
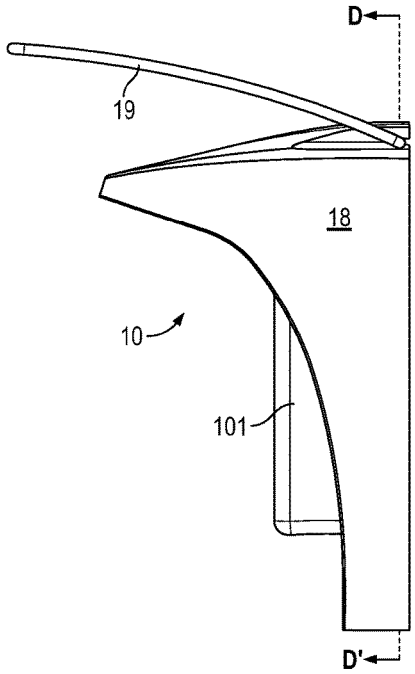

The back wall 202 of the housing 70 carries at its upper end centrally located between the housing right and left side walls a button guide member 242 providing a vertically extending channelway 243. The button 74 includes an enlarged top portion 245 and a stem 246 which extends downwardly from the top portion 245. The cover 18 is shown as having a button opening 247 vertically therethrough. The top portion 245 of the button 74 has a complementary shape to the button opening 247 such that when in a closed position as, for example, shown in FIGS. 4 and 21, an upwardly directed surface of the button 74 is coplanar with an upwardly directed surface of the top wall 21 of the cover 18. The button 74 may be manually engaged through the button cover opening 247 to move the button 74 downwardly. The stem 246 of the button 74 is coupled to the button guide member 242 received in the channelway 243 to limit the button 74 to vertical sliding movement and against uncoupling.

Figure 24:
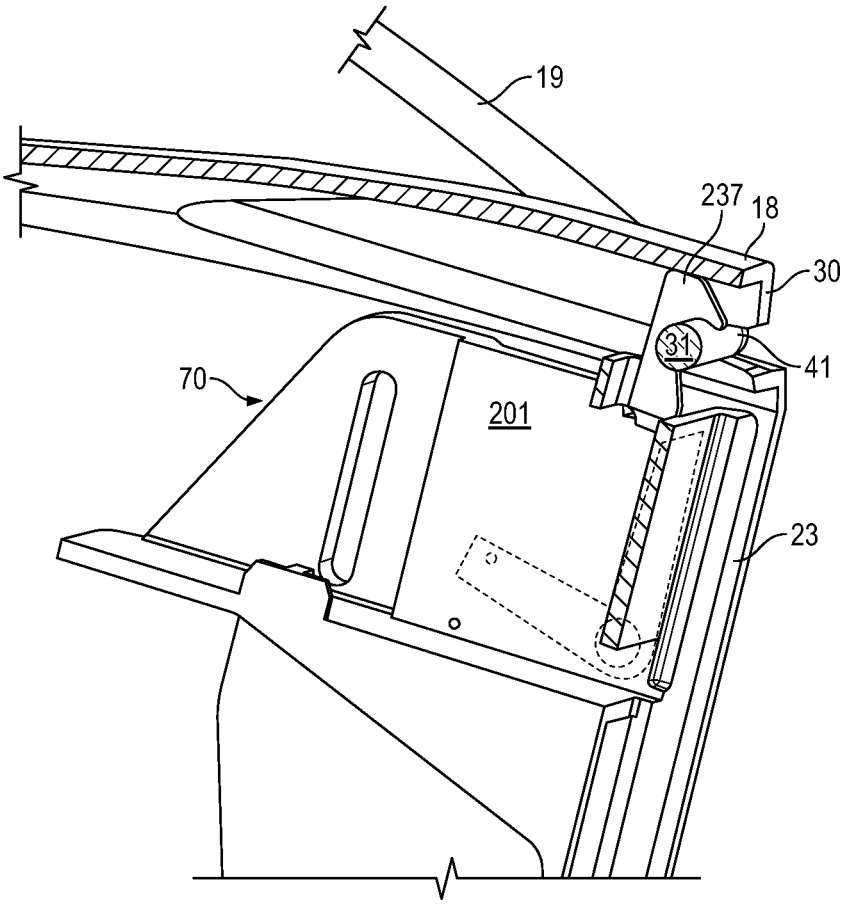
FIG. 24 is a partial pictorial view of an upper rear portion of the dispenser assembly in the lower closed position shown in FIG. 3 along a section line B-B' in FIG. 3.

As is best seen in FIG. 17, the stem 246 of the button 74 carries a camming surface 248 for engagement with the cam surface 239 on the cam plate 238 of the hook bracket 71. With downward movement of the button 74, the camming surface 248 of the stem 246 of the button 74 engages the cam surface 239 of the cam plate 238 on the hook bracket 71 so as to pivot the hook bracket 71 about the hook axis 222 moving the right and left hooks 236 and 237 forwardly from a latched position as shown in FIG. 24 to a unlatched position as shown in solid lines in FIG. 25.

Figure 16:
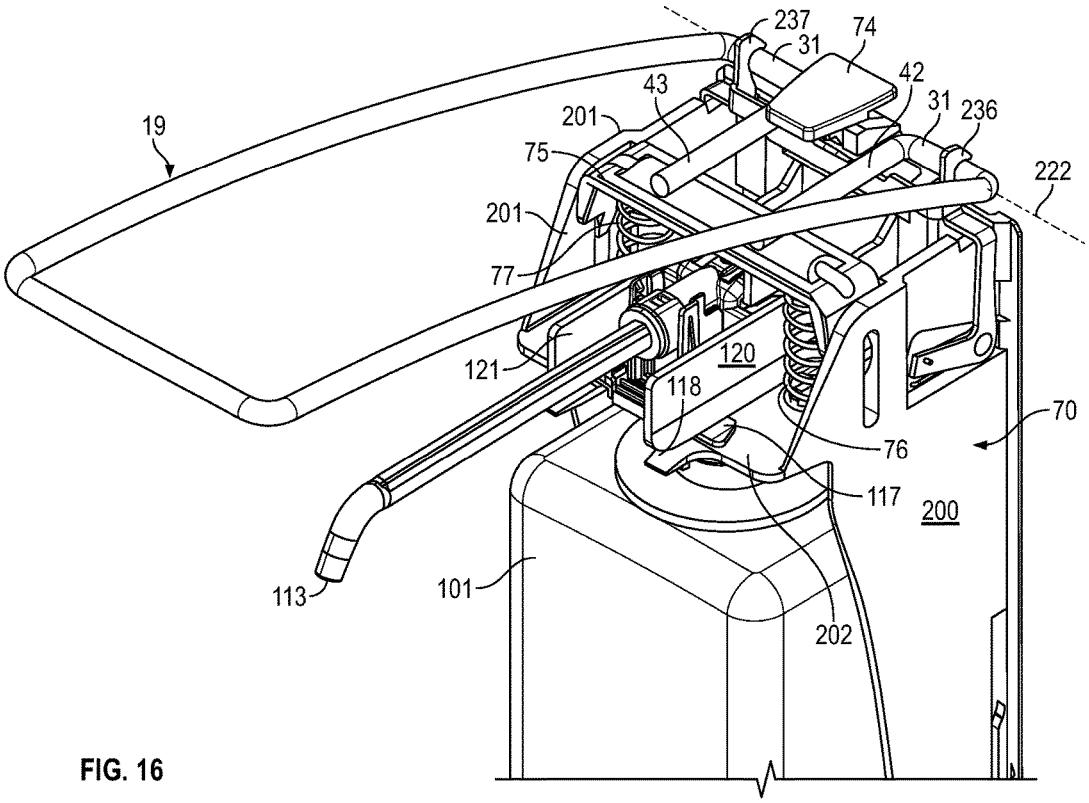
FIG. 16 is a partial pictorial view of the dispenser assembly of FIG. 3 with the cartridge coupled to the housing assembly, however, with the cover removed.

FIG. 16 illustrates the dispenser assembly 10 in an operative condition ready for use to dispense fluid, however, with the cover 18 removed. As can be seen in FIG. 16, the right and left hooks 236 and 237 of the hook bracket 71 engage on the lever axle 31 to prevent movement of the lever axle 31 forwardly or upwardly. The condition of FIG. 16 is also shown in FIG. 24 in cross-section with the left hook member 237 engaged on the left segment 41 of the lever axle 31. From the operative condition of FIG. 16 on a user engaging the button 74 and forcing the button 74 downwardly, with downward movement of the button 74, the hook bracket 71 is pivoted about the hook axis 222 relative to the housing 70 to pivot both the right hook 236 and the left hook 237 from the latched condition on the lever axle 31. As shown in FIG. 24, the left hook 237 is engaged about the left segment 41 of the axle 31 and on pivoting the hook bracket 71 forwardly, the left hook 237 is moved to an unlatched condition as shown in solid lines in FIG. 25 in which the left hook 253 is disposed forwardly of the left segment 41 of the axle 31.

Referring to FIG. 14, each of the right and left housing side walls 200 and 201 carry a respective right and left rod receiving slotways 260 and 261 open at open ends 266 and 267 in bottom edges 262 and 263 of the housing side walls 200 and 201 and extending vertically upwardly to respective blind ends 264 and 265. The rod receiving slotways 260 and 261 are sized so as to receive the rod member 20 of the cover 18 therein and locate the right cover side wall 22 laterally to the right outwardly of the housing right side wall 200 and the left cover side wall 23 laterally to the left outwardly of the housing left side wall 201. When the rod member 20 is within the rod receiving slotways 260 and 261, the slotways 260 and 261 engage the rod member 20 and guide relative sliding movement of the rod member 20 relative to the housing 70. The rod member 20 may pass inwardly and outwardly through the open ends 266 and 267 of the slotways 260 and 261 to disengage the rod member 10 from the slotways 260 and 261 or to engage the rod member 20 in the slotways 260 and 261. The housing 70 is symmetrical about the longitudinal central axis A-A' in FIG. 3 with each of the right and left housing side walls 200 and 201 being mirror images of the other.

Figure 27:
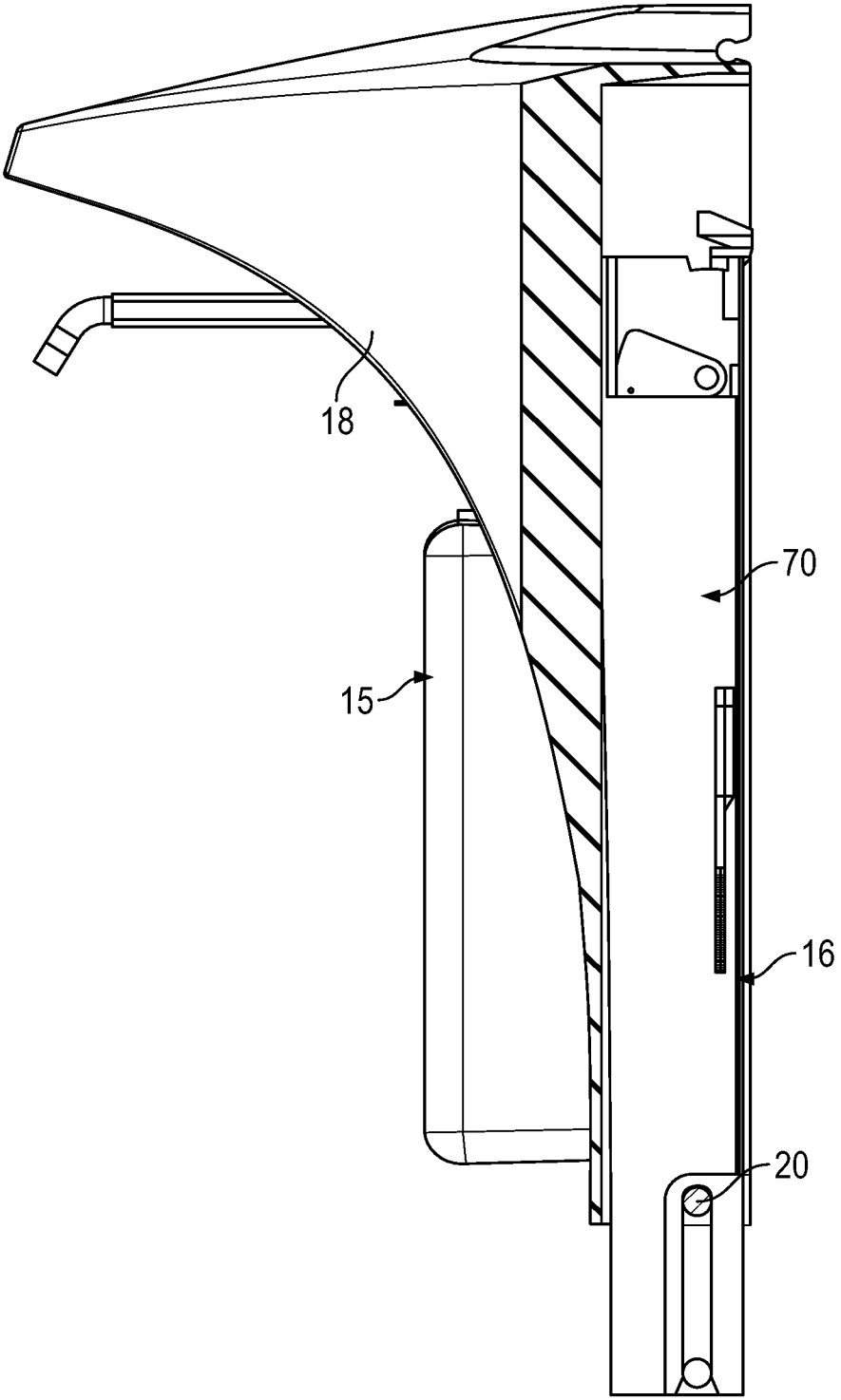
FIG. 27 is a view the same as FIG. 26, however, showing the cover in an upper open position relative to the housing assembly as in FIG. 19 and with the lever removed for ease of illustration.

Reference is made to FIGS. 14, 15, 30 and 31 to describe left and right slide grooves 270 and 271 which extend laterally through the respective left and right housing side walls 200 and 201 proximate the back wall 202 of the housing 70. Each of the slide grooves 270 and 271 extend vertically from bottom ends 276 and 277 to top ends 278 and 279. Each of the slide grooves 270 and 271 has a rearwardly directed front surface 280 and 281 disposed in the same flat vertical plane. Over upper portions 272 and 273 of each slide groove 270 and 271, respectively, each slide groove has a forwardly directed upper rear surface 282 and 283 which is vertical and spaced rearwardly from the respective front surfaces 280 and 281 by a first distance. Over a lower portion 274 and 275 of each slide groove 270 and 271, respectively, each slide groove has a forwardly directed lower rear surface 284 and 285 spaced rearwardly from the respective front surface 280 and 281 by a second distance less than the first distance. The first distance and the vertical dimension of the upper portions 272 and 273 of the guide grooves 270 and 271 are selected so as to permit the respective right and left latch members 48 and 49 carried on the right and left cover side walls 22 and 23 to slide laterally through the respective upper portions 272 and 273 of the slide grooves 270 and 271 when the right and left locking members 48 and 50 are vertically and horizontally aligned with the upper portions 272 and 273 of the slide grooves 270 and 271 as occurs when the cover assembly 14 is engaged on the housing assembly 16 in the upper open position shown, for example, in FIG. 27 in right side view, in FIG. 32 in pictorial view and in cross-section in rear views in FIGS. 29 and 35.

Figure 29:
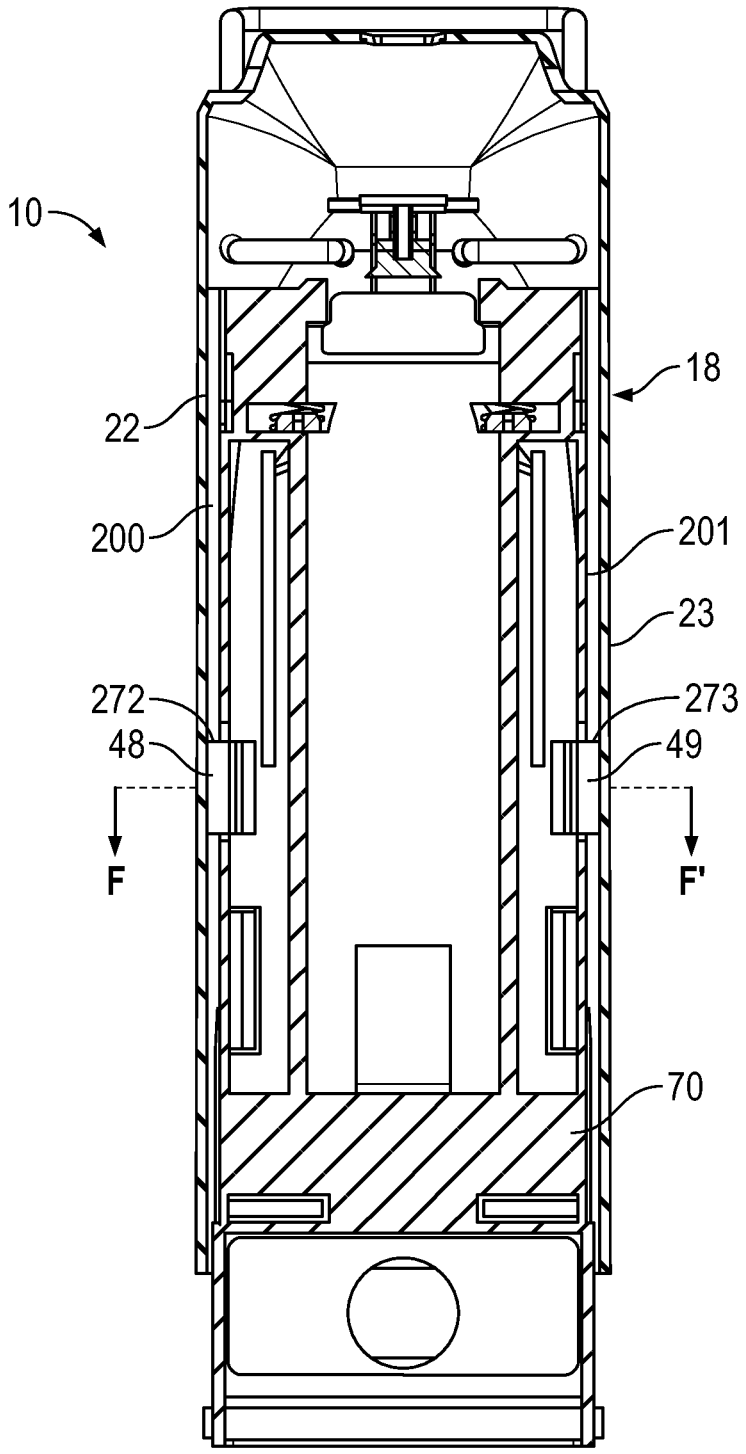
FIG. 29 is a rear cross-sectional view the same as FIG. 28, however, with the cover assembly in the upper open position as in FIG. 20.
Figure 35:
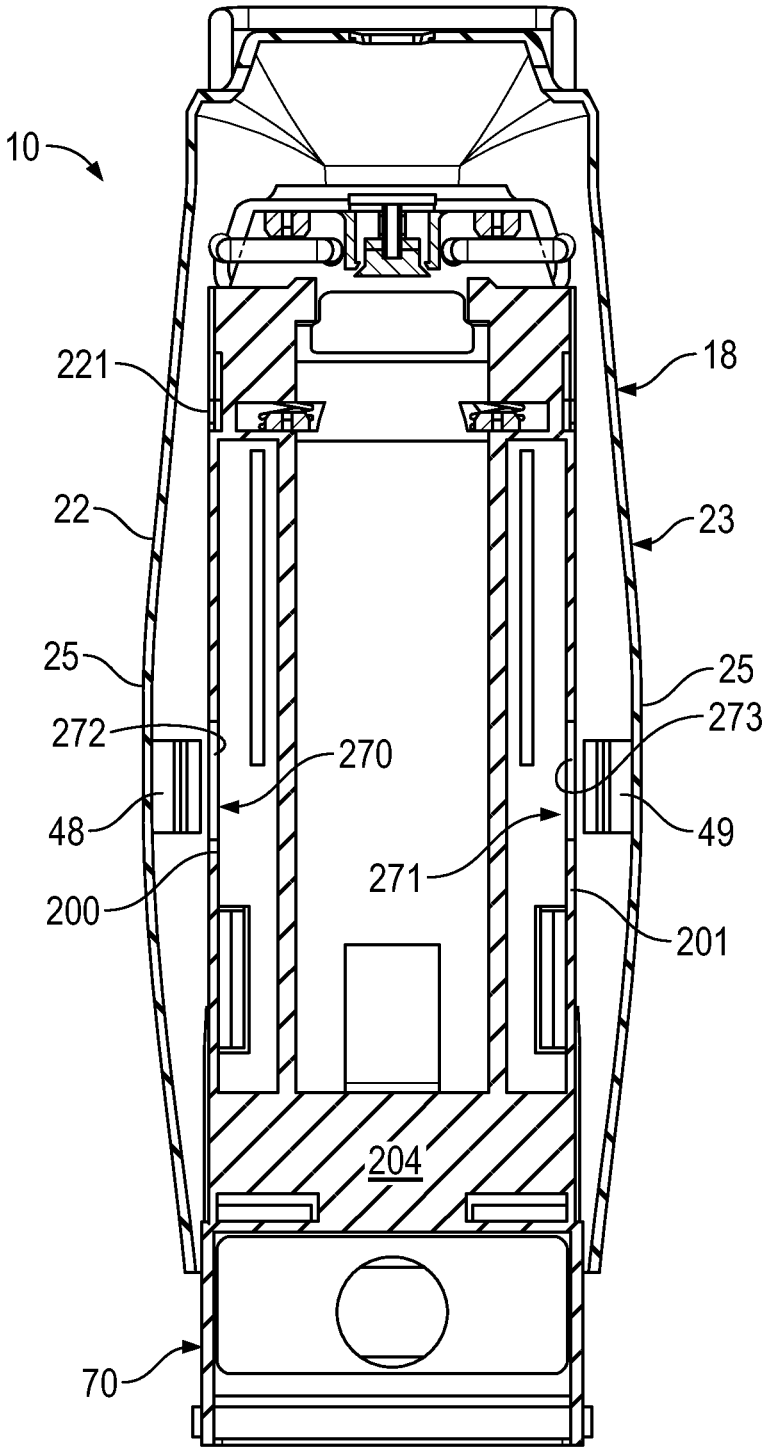
FIG. 35 is a rear pictorial view the same as FIG. 29, however, with the side walls of the cover deflected to be spaced laterally further apart from each other than in FIG. 29.

At least the intermediate portion 25 of the right cover side wall 22 of the cover 18 is resilient and has an inherent bias to adopt a right inherent condition as illustrated in all of the Figures showing the cover 18 other than FIG. 35. The right cover side wall 22 is shown in its right inherent condition, for example, in a cross-sectional rear view in FIG. 29. In FIG. 29, the cover assembly 14 is in the upper open position relative the housing assembly 16 and the right cover side wall 22 is laterally to the right of the right housing side wall 200 and the right latch member 48 extends through the right housing side wall 200 via the upper portion 272 of the right guide groove 270. The right cover side wall 22 is deflectable from the right inherent condition as shown in FIG. 29 to right deflected conditions in which the intermediate portion 25 of the right cover side wall 22 is laterally to the right of the right inherent condition. One such right deflected condition is illustrated in FIG. 35 in which the right cover side wall 22 is laterally to the right of the housing right side wall 200 and the right latch member 48 carried on the right cover side wall 22 is laterally to the right of the right housing side wall 200. Similarly, at least the intermediate portion 25 of the left cover side wall 23 of the cover 18 is resilient and has an inherent bias to adopt a left inherent condition as illustrated in all of the Figures other than FIG. 35. The left cover side wall 23 is shown in its left inherent condition, for example, in a cross-sectional rear view in FIG. 29. In FIG. 29, the left cover side wall 23 is disposed laterally to the left of the housing left side wall 201 and the left latch member 49 extends through the left housing side wall 201 via the upper portion 273 of the left guide groove 271. The left cover side wall 23 is deflectable from the left inherent condition as shown in FIG. 29 to left deflected conditions in which the intermediate portion 25 of the left cover side wall 23 is laterally to the left of the left inherent condition. One such left deflected condition is illustrated in FIG. 35 in which the left cover side wall 23 is laterally to the left of the housing left side wall 201 and the left latch member 49 carried on the left cover side wall 23 is laterally to the left of the housing left side wall 201.

Figure 33:
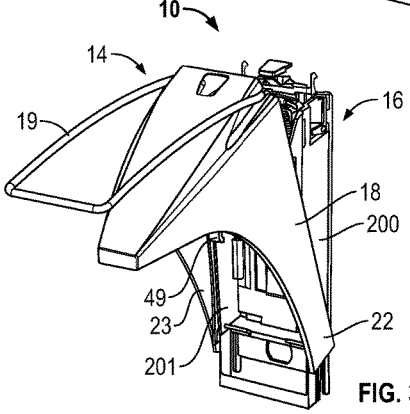
FIG. 33 is a perspective view of the dispenser assembly the same as FIG. 32 but with an upper portion of the cover assembly disengaged from the housing assembly and the cover assembly tilted forwardly.
Figure 34:
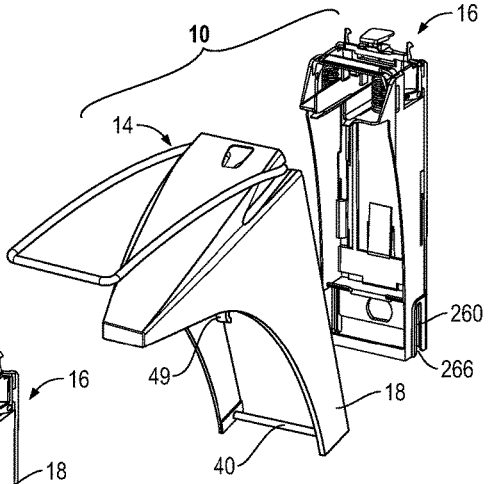
FIG. 34 is a pictorial view the same as FIG. 33, however, showing the cover assembly as disengaged from the housing assembly.

From the condition of FIG. 29, by manually urging the intermediate portions 25 of the left and right cover side walls 22 and 23 laterally outwardly away from each other, the right latch member 48 and the left latch member 49 move laterally away from each other laterally through and out of engagement with the right and left upper portions 272 and 273 of the right and left guide grooves 270 and 271 to assume the deflected conditions illustrated in FIG. 35. In FIG. 35, the rod member 20 of the cover 18 is received in the rod receiving slotways 260 and 261 in the right and left housing side walls 200 and 201. In the condition of FIG. 35, the cover assembly 14 is merely engaged with the housing assembly 16 by reason of the rod member 20 being received within the slot receiving slotways 260 and 261. While maintaining the right and left cover side walls 22 and 23 in deflected positions as in FIG. 35, from the condition of FIG. 35, the cover assembly 16 may be pivoted about the rod member 20 within the rod receiving slotways 260 and 261 to pivot an upper end of the cover assembly 14 forwardly until the right and left latch members 48 and 49 are forward of the right and left housing side walls 200 and 201 as shown in FIG. 33. The right and left side walls 22 and 23 may then be released and permitted to return under their inherent bias to the right and left inherent positions. From the position of FIG. 33, the cover assembly 14 may be manipulated such that the rod member 20 is slid downwardly in the rod receiving slotways 260 and 261 and out the open ends 266 and 267 to totally disengage the cover assembly 14 from housing assembly 16 and assume a disengaged condition as illustrated in FIG. 34.

Figure 31:
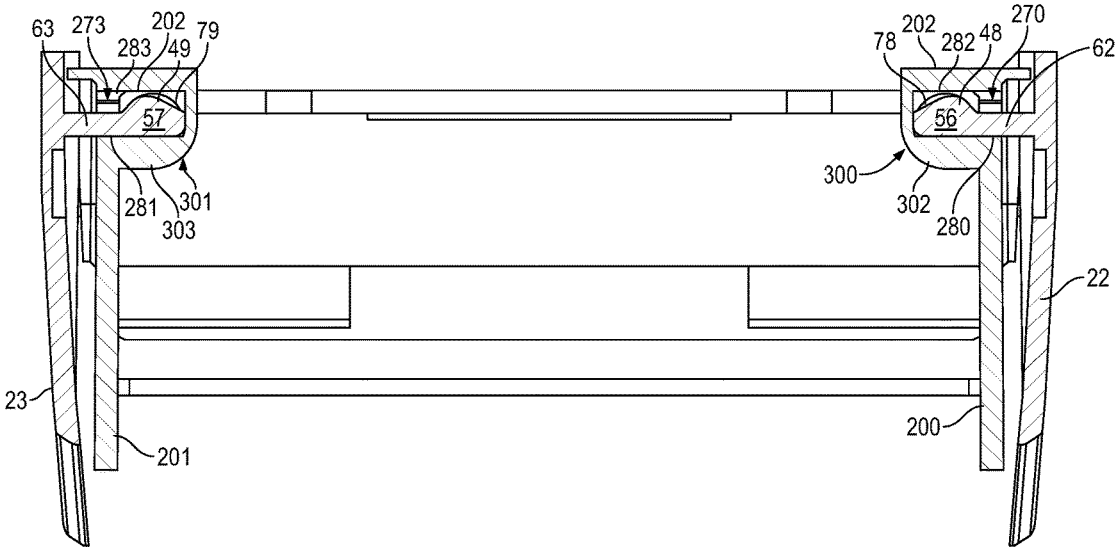
FIG. 31 is a cross-sectional top view along section line F-F' in FIG. 29.

Reference is made to FIG. 31 which illustrates a top cross-sectional view along section line F-F' in FIG. 29 showing the left and right latch members 48 and 49 within the upper portions 272 and 273 of the slide grooves 270 and 271 with each of the right and left cover side walls 22 and 23 in their inherent condition. As can be seen, the first distance separating the front surfaces 280 and 281 from the upper rear surfaces 282 and 283 is sufficient to permit the enlarged bulbous portions 56 and 57 at the distal inner ends 54 and 55 of the right and left latch members 48 and 49 to be slid laterally outwardly through the upper portions 272 and 273 of the slide grooves 270 and 271.

Figure 28:
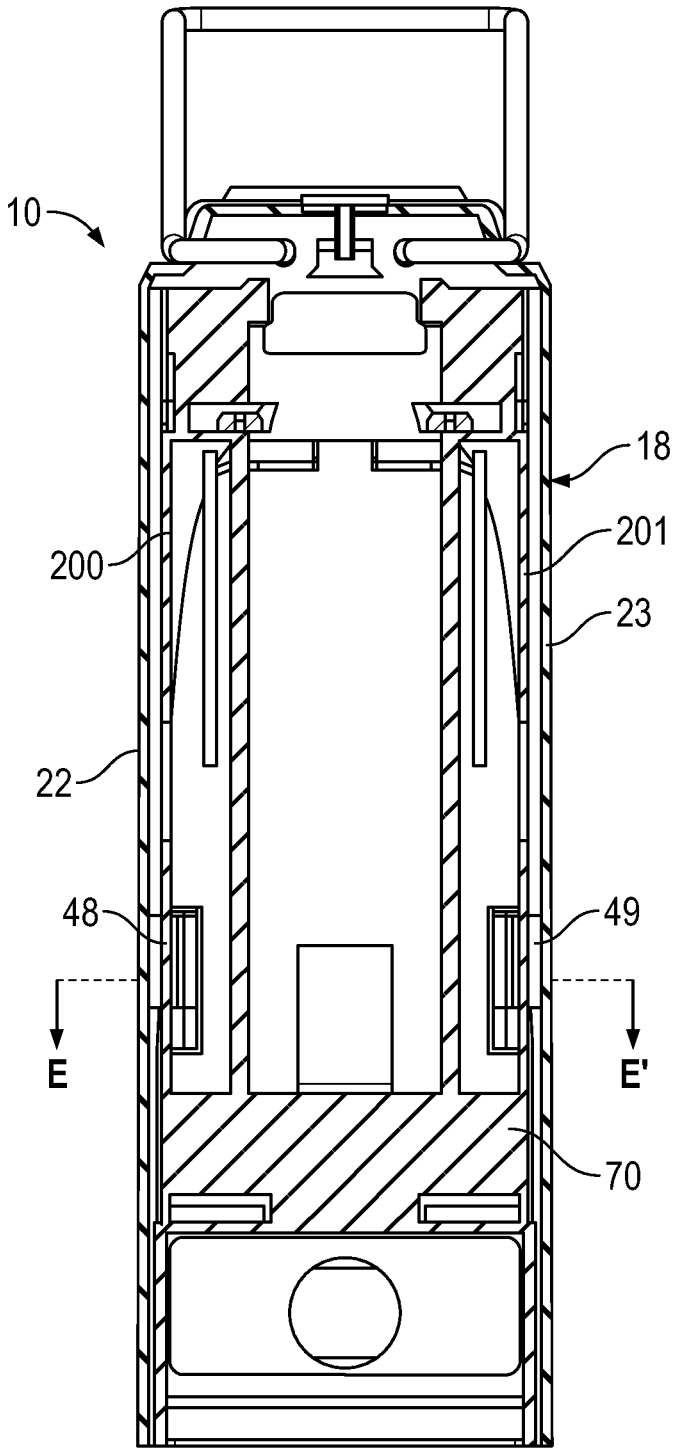
FIG. 28 is a rear cross-sectional view of the dispenser assembly of FIG. 3 along section line D-D' in FIG. 5 with the cover assembly in the lower closed position.

FIG. 29 illustrates a cross-sectional rear view in which the cover assembly 14 is in the upper open position relative to the housing assembly 16. From the upper open position of FIG. 29, the cover assembly 14 is slidable relative to the housing assembly 16 to a lower closed position as illustrated in FIG. 28. In FIG. 28, the right and left latch members 48 and 49 on the cover side walls 22 and 23 have been slid downwardly from the upper portions 272 and 273 of the slide grooves 270 and 271 into the lower portions 274 and 275 of the slide grooves 270 and 271. In the lower portions 274 and 275, the second distance between the front surfaces 280 and 281 and the lower rear surfaces 284 and 285 is selected to be marginally greater than the thickness of the reduced thickness portions 62 and 63 of the right and left latch members 48 and 49 and less than the front to rear dimension of the bulbous portions 56 and 57 at the distal inner ends 54 and 55 of the right and left latch members 48 and 49. Thus, as seen in FIG. 30 which is a top cross-section through FIG. 28, when in the lower closed position, the left and right latch members 48 and 49 are prevented from being moved laterally outwardly through the lower portions 272 and 273 of the guide grooves 270 and 271.

Reference is made to FIGS. 14 and 15 which show a left lift spring socket 301 to retain the left cover lift spring 79 at a location that an upper end of the left cover lift spring 79 engages a bottom edge 297 of the left latch member 49 to urge the left latch member 49 upwardly within the left slide groove 271. The left lift spring socket 301 has an inner side wall 303 bridging between the housing left side wall 201 and the back wall 202. The left lift spring socket 301 is closed at a lower end by a bottom wall 305 and is partially closed at an upper end by a partial top wall 307. An upper opening 309 is provided into the left lift spring socket 301 past the partial top wall 307 via which the left cover lift spring 79 may be forced such that the left cover lift spring 79 comes to be received extending axially vertically within the left lift spring socket 301 with the lower end of the left cover lift spring 79 engaged on the bottom wall 305 and the left cover lift spring 79 being prevented from being removed from the left lift spring socket 301 by engagement of the upper end of the left cover lift spring 79 with the partial top wall 307. The opening 309 of the left lift spring socket 301 is of a size to permit the left latch member 49 on the cover 18 disposed within the left slide groove 271 to slide downwardly into the left lift spring socket 301 into engagement with the upper end of the left cover lift spring 79. As shown in FIGS. 30 and 31, a right lift spring socket 300 is provided on the right housing side wall 200 as a mirror image of the left lift spring socket 301 to receive the right cover lift spring 78. An upper opening 308 of the right lift spring socket 300 is of a size to permit the right latch member 48 on the cover 18 disposed within the right slide groove 270 to slide downwardly into the right lift spring socket 300 into engagement with the upper end of the right cover lift spring 79. The right lift spring socket 300 similarly has an inner side wall 302, a partial top wall and is closed by a bottom wall.

Coupling of the cover assembly 14 to the housing assembly 16 is now described with reference to FIGS. 32 to 35. FIG. 34 illustrates a condition in which the cover assembly 14 is separate, disengaged and uncoupled from the housing assembly 16. From the position of FIG. 34, the cover assembly 14 is manually moved so as to move the rod member 20 upwardly into the opening ends 266 and 267 of the rod receiving slotways 260 and 261 and to then, with the upper end of the cover assembly 14, tilted upwardly and forwardly from the rod member 20, slide the rod member 20 upwardly in the rod receiving slotways 260 and 261 until the rod member engages the upper blind ends 264 and 265 of the rod receiving slotways 260 and 261 and the cover assembly 14 assumes the position shown in FIG. 33. As seen in FIG. 33, each of the right and left cover side walls 22 and 23 are disposed laterally outwardly of the right and left housing side walls 200 and 201. From the position of FIG. 33, with the rod member 20 engaged with the blind ends 264 and 265 of the rod receiving slotways 260 and 261, the cover assembly 14 is pivoted about the rod member 20 rearwardly at the same time that deflecting forces are applied to each of the right and left cover side walls 22 and 23 to urge them laterally outwardly away from each other to adopt the deflected condition shown in FIG. 35 such that with pivoting of the cover assembly 14 about the rod member 20, the right and left latch members 48 and 49 pass laterally outwardly of the right and left housing side walls 200 and 201 to the position shown in FIG. 35 in which the right and left latch members 48 and 49 are laterally aligned with the right and left upper portions 272 and 273 of the right and left guide grooves 270 and 271. When so aligned, the deflecting forces applied to the right and left cover side walls 22 and 23 are released. Due to the inherent resiliency of each of the cover side walls 22 and 23, on release of the deflecting forces, the right and left cover side walls 22 and 23 move from the deflected condition of FIG. 35 to the inherent condition of FIG. 29 with the right and left latch members 48 and 49 to pass laterally inwardly into the upper portions 272 and 273 of the slide grooves 270 and 271 and assume the position shown in FIG. 31. The cover assembly 14 is now coupled to the housing assembly 16 in an upper open position as shown, for example, in FIG. 32.

Figure 32:
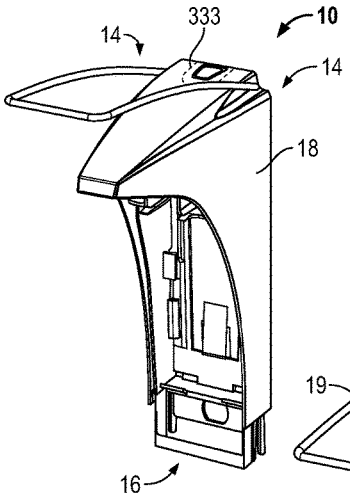
FIG. 32 is a perspective view of the dispenser assembly in FIG. 20 with the cover assembly in an upper open position.

Removal of the cover assembly 14 from the housing assembly 16 is accomplished by reversing the steps described above so as in sequence to adopt the configurations shown in FIG. 32, then in FIG. 33 and finally in FIG. 34, with the cover side walls 22 and 23 being deflected to the deflected condition of FIG. 35 during the movement from the position of FIG. 32 to the position of FIG. 33.

Figure 19:
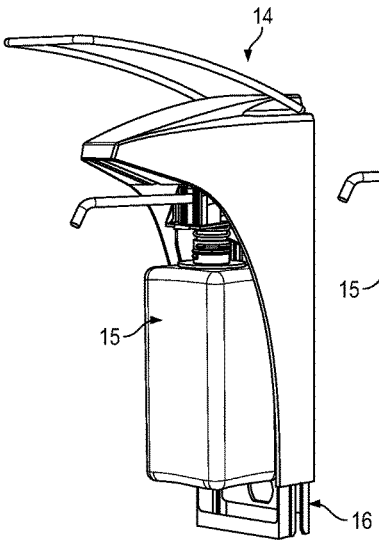
FIG. 19 is a pictorial view the same as FIG. 18 but with the cover assembly in an upper open position.
Figure 20:
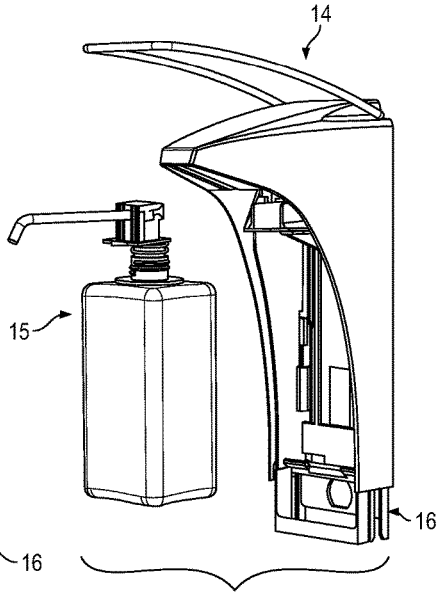
FIG. 20 is a pictorial view of the dispenser of FIG. 19 in which the cartridge has been slid horizontally forwardly to a position to which and from which the cartridge may be slid horizontally, forwardly and rearwardly for respective coupling and uncoupling of the cartridge to the dispenser housing assembly.

In FIG. 32, the carriage assembly 14 is coupled to the housing assembly 16 in an upper open position that is also shown in FIGS. 19 and 20 as well as FIGS. 23, 27, 29 and 31.

Figure 18:
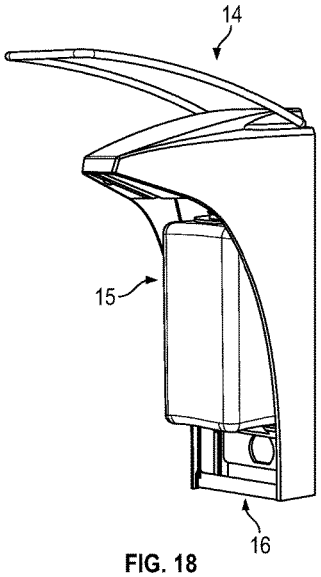
FIG. 18 is a pictorial view of the dispenser assembly of FIG. 1 mounted on the mounting plate in an operative position with the cover assembly in a lower closed position.

With the cover assembly 14 coupled to the housing assembly 16, the cover assembly 14 is vertically slidable relative the housing assembly 16 from the upper open position of FIG. 32 to the lower closed position shown in FIG. 18. The cover assembly 14 is shown coupled to the housing assembly 16 in the lower closed position not only in FIG. 18 but also in each of FIGS. 1 to 5, 16 to 18, 21, 24, 26, 28 and 30. In moving between the lower closed position of FIG. 18 and the upper open position of FIG. 19, the cover assembly 14 is slidably guided relative to the housing assembly 16 by reason of: (a) the rod member 20 on the lower portions 26 of the cover side walls 22 and 23 being guided within the rod receiving slotways 260 and 261 in the housing side walls 200 and 201 concurrently with (b) the left and right latch members 48 and 49 on the intermediate portions 25 of the cover side walls 22 and 23 being guided within the slide grooves 270 and 271 of the housing side walls 200 and 201.

In such relative sliding of the cover assembly 14 relative to the housing assembly 16, while the left and right latch members 48 and 49 are within the lower portions 274 and 275 of the guide grooves 270 and 271, the left and right cover lift springs 78 and 79 engage the left and right latch members 48 and 49 and bias the cover assembly 14 to move upwardly to the upper open position.

In the lower closed position, the left and right hooks 236 and 237 on the hook bracket 71 engage on the axle 31 of the lever 19 to retain the cover assembly 14 in the lower closed position against upward movement of the cover assembly 14 relative to the housing assembly 16. The engagement of the left and right hooks 236 and 237 of the hook bracket 71 carried by the housing 770 onto the axle 31 of the lever 19 is clearly shown in FIG. 16 albeit with the cover 18 removed for ease of illustration. The engagement of the left hook 237 of the bracket member 71 on the left segment 41 of the axle 31 with the cover in the lower closed position is clearly shown in cross-section in FIG. 24. FIG. 21 also shows the cover assembly 16 in the lower closed position relative to the housing assembly 16 in which the hooks 236 and 237 engage on the axle 31 of the lever 19. In the lower closed position as shown in FIG. 21, a user manually pushes the button 74 downwardly through the button opening 247 of the cover 18. With downward movement of the button 74, the button camming surface 248 engages the cam surface on the cam plate of the hook bracket 71 pivoting the hook bracket 71 about the stub axles 220 and 221 against the bias of the hook springs 72 and 73 so as to pivot the left and right hooks 236 and 237 forwardly relative to the axle 31 to assume a forward disengaged position relative the axle 31 as illustrated in the cross-section of FIG. 25 showing the left hook 237 in a forwardly pivoted disengaged position spaced forwardly from the axle 31.

Figure 22:
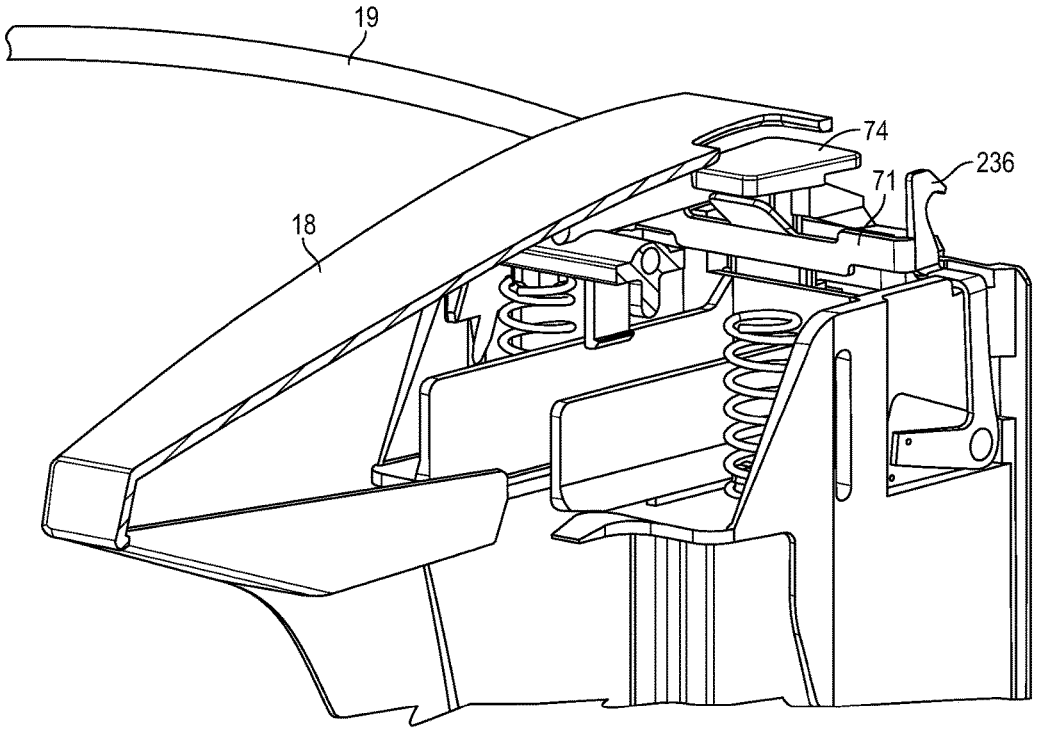
FIG. 22 is a view the same as FIG. 21, however, in which a latching engagement member on the housing assembly has been moved to release a cover latching mechanism.
Figure 23:
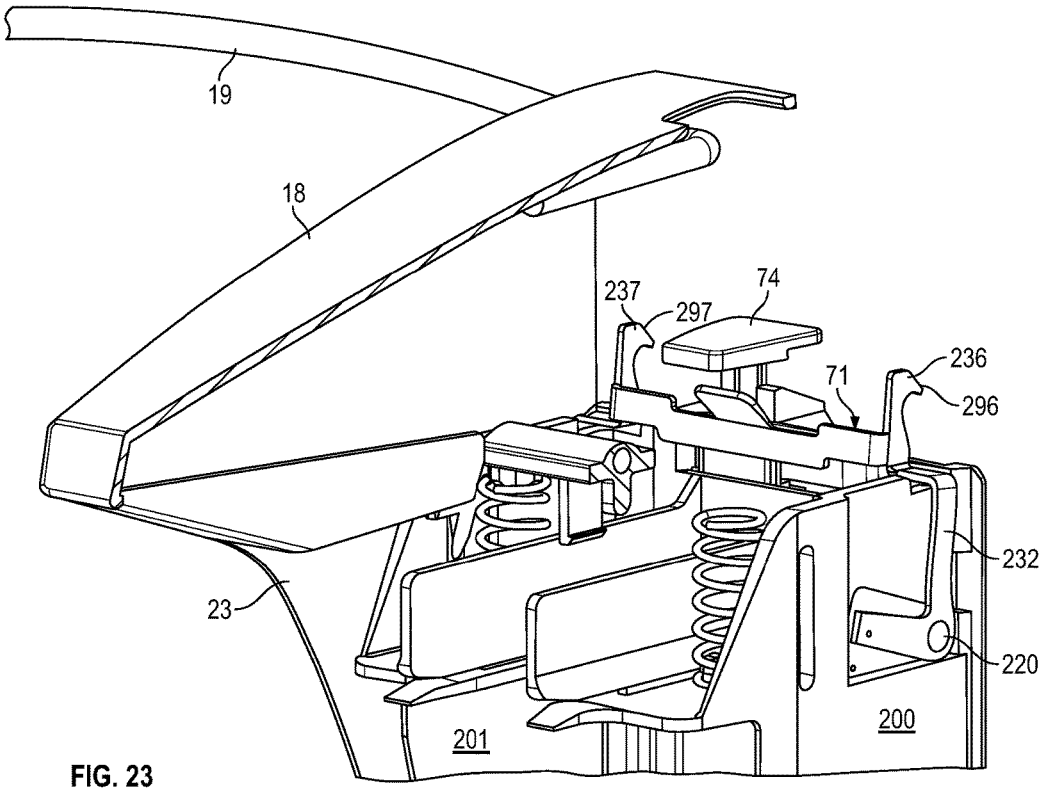
FIG. 23 is a pictorial view the same as FIG. 21, however, in which the cover assembly has been slid relative to the housing assembly from the lower closed position as shown in FIGS. 21 and 22 to an upper open position.
Figure 25:
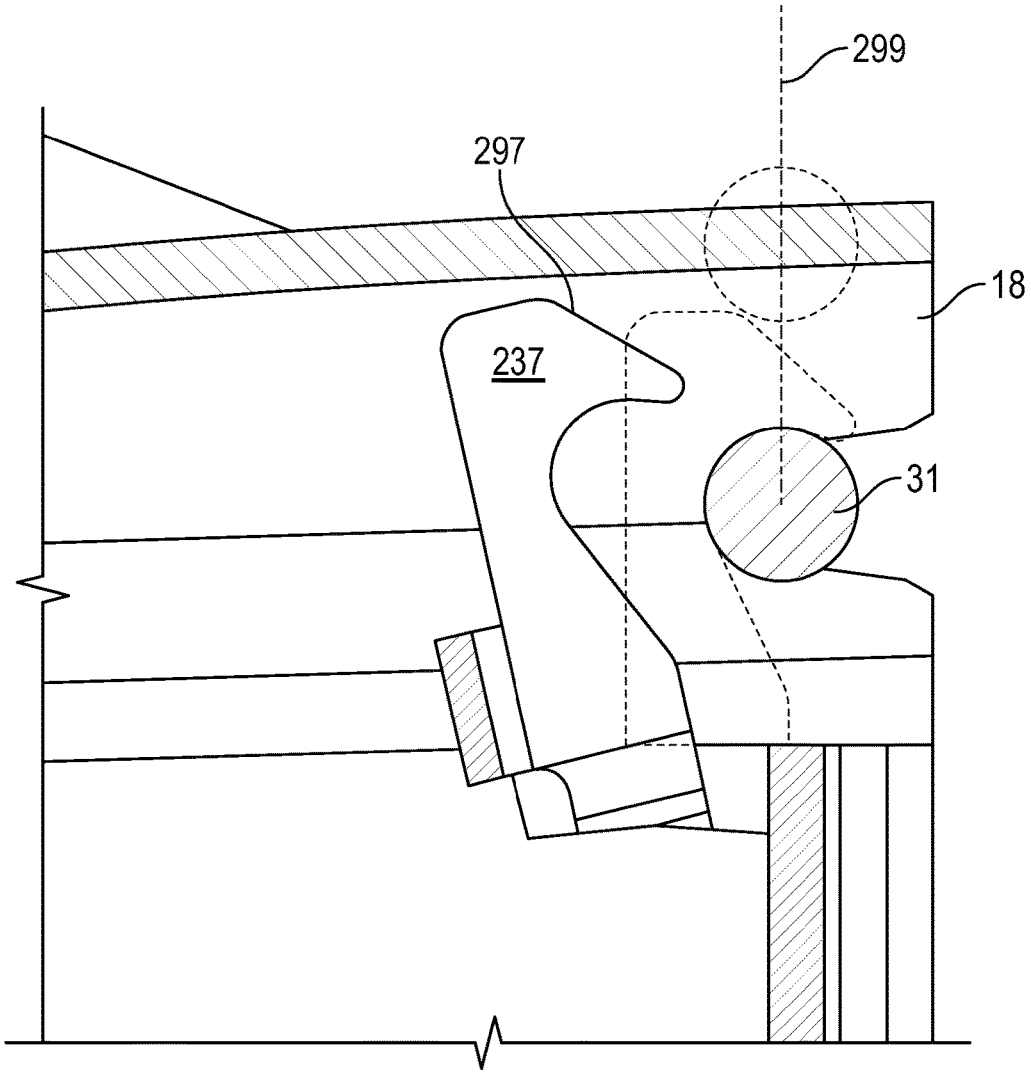
FIG. 25 is an enlarged cross-sectional right side view of the upper rear portion of the dispenser assembly as shown in FIG. 3 along section line B-B' in FIG. 3.
Figure 26:
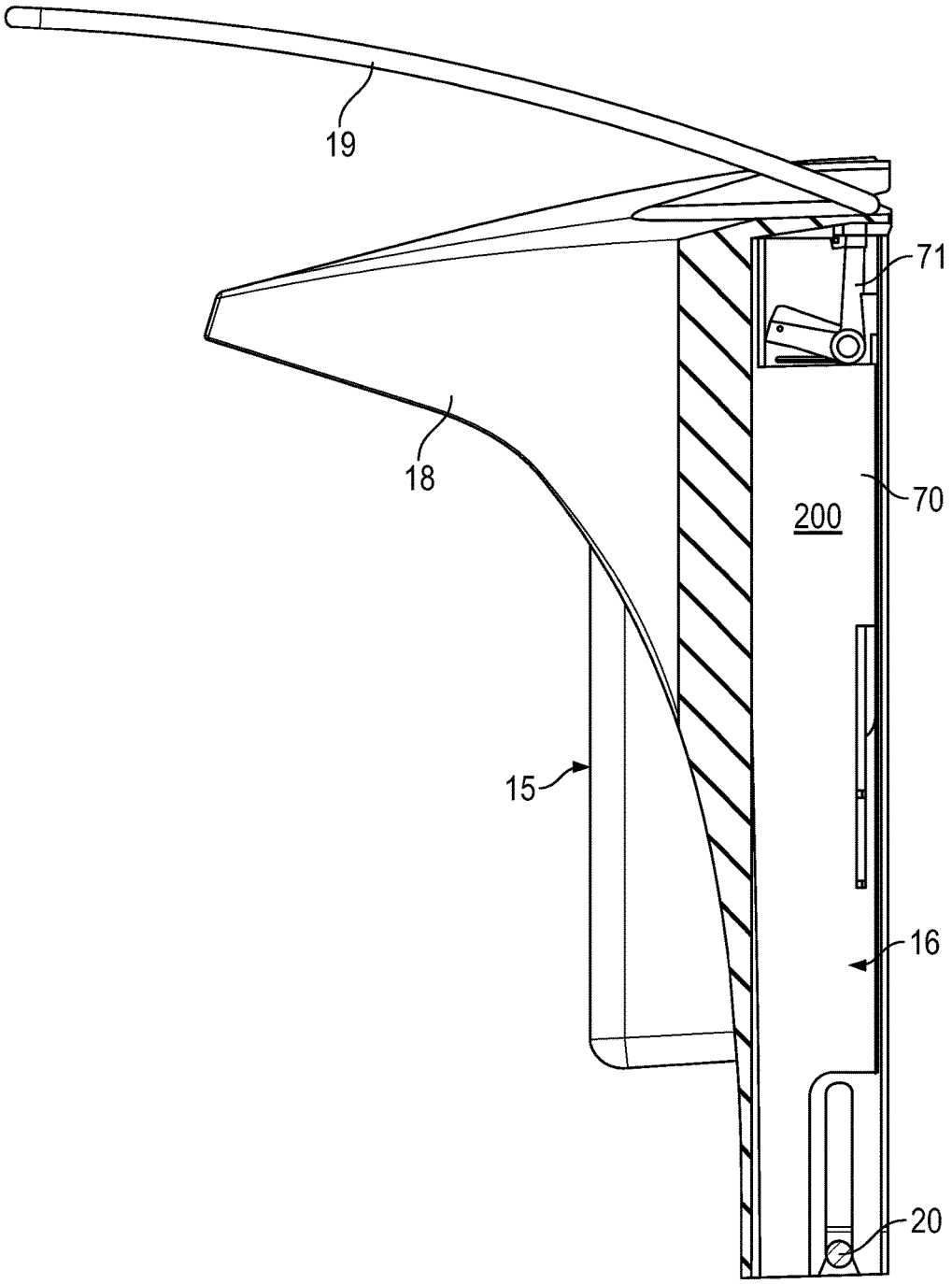
FIG. 26 is a cross-sectioned right side view of the dispenser assembly of FIG. 3 along section line C-C' in FIG. 3.

On the left and right hooks 236 and 237 coming to disengage from the axle 31 by the forward rotation of the hook bracket 71 to the position shown, for example, in FIGS. 22 and 25, under the forces applied by the right and left cover lift springs 78 and 79 on the right and left latch member 48 and 49, the cover assembly 14 is slid upwardly from its lower closed position of FIG. 22 to the upper open position as seen in FIG. 23. With the manual disengagement of the button 74 after the axle 31 has passed vertically upwardly past the hooks 236 and 237, the hook bracket 71 is pivoted under the bias of the right and left hook springs 72 and 73 to which rearward position shown in FIG. 24 and in dashed lines in FIG. 25.

To move the cover assembly 14 relative to the housing assembly 16 from the upper open position, for example, as shown in FIG. 23 to the lower closed position, the user manually engages the top wall 21 of the cover 18 and forces cover 18 vertically downwardly against the bias of the right and left cover lift springs 78 and 79. With this vertical downward movement, the axle 31 of the lever 19 moves vertically downwardly with the axle axis 32 moving along a dotted line 299 shown in FIG. 25. In such downward movement, the axle 31 as schematically shown in broken lines in FIG. 25, engages upwardly directed exterior camming surfaces 296 and 297 on the right and left hooks 236 which engagement with downward movement of the axle 31 biases the right and left hooks 256 and 257 and thereby the hook bracket 71 to pivot about the stub axles 220 and 221 forwardly to the forward position shown in solid lines in FIG. 25 against the bias of the right and left hook springs 72 and 73. Once the axle 31 has moved downwardly passed the left and right hooks 236 and 237, the hook bracket 71 moves under the bias of the right and left hook springs 72 and 73 from the forward position to the rear position shown in broken lines in FIG. 25 to latch onto the axle 31 holding the cover assembly 14 in the lower closed position relative to the housing assembly 16 as illustrated, for example, in FIG. 24.

Thus, as explained above, the cover assembly 14 is coupled to the housing assembly 16 for movement between the closed lower position and an open upper position. The housing assembly 16 has a releasable cover latching mechanism formed by the pivotally mounted hook bracket 71, the right and left hooks 236 and 237, the hook springs 72 and 73, the cam plate 238 as well as the button 74 and the button guide member 242.

Reference is made to FIG. 7 which illustrates a cartridge 15 comprising a pump mechanism 100 and a fluid containing bottle 101. As illustrated in FIGS. 19 and 20, when the cover assembly 14 is in the upper open position relative to the housing assembly 16, by relative horizontal movement of the cartridge 15, the cartridge 15 may be moved horizontally forwardly and rearwardly between a disengaged uncoupled condition in front of the dispenser assembly 10 as seen in FIG. 20 and to a coupled orientation seen in FIG. 19. With the cartridge 15 in the coupled orientation as in FIG. 19, the cover assembly 14 may be moved relative the housing assembly 16 from the upper open condition of FIG. 19 to the lower closed position of FIG. 18 capturing the cartridge 15 within the dispenser assembly 10 against removal and locating the cartridge assembly 15 in an operative position for dispensing of fluid from the bottle 101 of the cartridge 15 by activation of the pump mechanism 100 with the lever 19.

Figure 3:
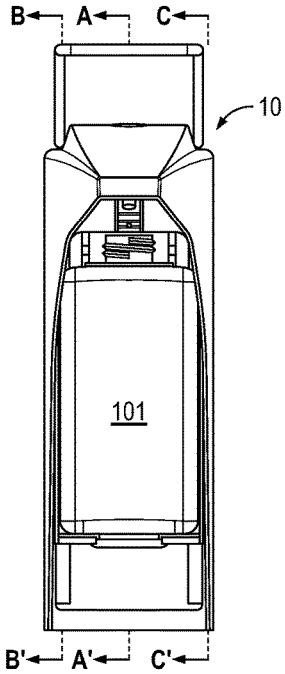
FIGS. 3, 4 and 5 are, respectively, a front view, a pictorial view and a right side view of the dispenser assembly of FIG. 2.

Reference is made to FIG. 17 illustrating a cross-sectional view along longitudinal center line A-A' in FIG. 3 showing the cartridge 15 coupled within the dispenser assembly 10 with the cover assembly 14 in the lower closed position relative to the housing assembly 16 in an operative condition ready for operation of the dispenser assembly 10 to dispense fluid. This operative condition is also illustrated in the pictorial view of FIG. 16, however, with the cover 18 removed for purposes of illustration.

The bottle 101 is enclosed by four side-by-side side walls 102 and a bottom wall 103 and is open merely through an opening 104 at the top of a cylindrical neck 105 extending upwardly from a top wall 106. The pump mechanism 100 includes notably a piston chamber-forming body 110 and a piston-forming element 111. The piston-forming element 111 is coaxially slidable about a vertical axis relative to the piston chamber-forming body 110 to draw fluid from the bottle via a dip tube 112 connected to the piston chamber-forming body 110 and discharge the fluid from a downwardly directed discharge outlet 113 carried at the front end of a forwardly extending discharge tube 114 that extends forwardly from and is carried by the piston-forming element 111.

When the cover assembly 14 is in the raised upper position relative the housing assembly 16, the cartridge 15 is horizontally slidable rearwardly to engage with the housing assembly 16 such that the bottle 101 comes to be received within a compartment 115 defined within the housing 70 intermediate the housing left and right side walls 200 and 201, forwardly of the back wall 202 and between the horizontal support flange 202 and a bottle support flange 116 that bridges between the housing side walls 200 and 201 with the bottom of the bottle 101 engaged and supported by the bottle support flange 116. The piston chamber-forming body 110 carries a horizontally extending support plate 117 that extends laterally to the left and the right. External portions of the piston-forming element 111 extend upwardly from the piston chamber-forming body 110 above the support plate 117. The pump mechanism 100 is slid rearwardly into engagement with the support flange 202 of the housing 70 into the slot 204 of the support flange 202 with the support plate 117 of the piston chamber-forming body 110 above the support flange 202 and extending laterally through the channelways 118 and 119 between the horizontal support flange 204 and the right and left vertical guide walls 120 and 121. In this manner, the piston chamber-forming body 110 is fixedly secured to the housing 70 against vertical movement.

The piston-forming element 111 is vertically slidably engaged within the piston chamber-forming body 110 for coaxial vertical reciprocal sliding about a vertical axis and with an internal spring (not shown) biasing the piston-forming element 111 vertically upward relative to the piston chamber-forming body 110. As shown in FIG. 17, the piston-forming element 111 is disposed vertically below the pump actuator plate 75. To dispense fluid with the dispenser assembly 10 in the orientation shown in FIG. 17 a user engages the exterior handle portion 32 of the lever 19 and moves the exterior handle portion 32 of the lever 19 downwardly pivoting the lever 19 relative to the housing 70 about the axle axis 35 which moves the forward ends of the right and left actuator rods 42 and 43 of the interior actuator portion 33 of the lever 19 downwardly causing the actuator plate 75 to slide vertically downwardly against the bias of the left and right plate springs 76 and 77 and move the piston-forming element 111 vertically downwardly relative to the piston chamber-forming body 10, dispensing fluid from the bottle 101 out the discharge outlet 113 onto a user's hand disposed underneath the outlet 113. On release of the lever 19 by the user, under the bias of the left and right plate springs 76 and 77, the pump actuator plate 75 returns to the raised position and pivots the lever 19 to return to the position shown in FIG. 17. The pump spring biases the piston-forming element 111 to return to a raised position as shown in FIG. 17.

The cartridge 15 is adapted to be removed and replaced preferably by a new cartridge, however, possibly with the bottle 101 being removed from the cartridge 15 and refilled. Removal and replacement of the cartridge 15 is possible as is removal and replacement of merely the pump mechanism 100 or merely the bottle 101. Removal and replacement is carried out with the cover assembly 14 in the upper open opposition relative the housing assembly as seen in FIGS. 19 and 20.

After use of the dispenser assembly 10 for periods of time, portions of the dispenser assembly 10 which may be engaged by users may become contaminated as with pathogens and the like. Preferably, from time to time, the cover assembly 14 is removed from the housing assembly 16 and the cover assembly may then be suitably cleaned as preferably by being placed in an autoclave or washing machine. The cover assembly 14 when cleaned may then be reattached to the housing assembly 16. Alternatively, a new or different cover assembly 14 and a new or different lever 19 may be applied. Coupling or removal of the cover assembly 14 from the housing assembly 16 is accomplished in a manner described with reference to FIGS. 32 to 35 with the cover 18 and the lever 19 coupled together. After removal of the cover assembly 14 from the housing assembly 16, the lever 19 can be removed from the cover 18 for separate washing and/or replacement. Separate washing of the cover 18 and lever 19 is advantageous to clean the surfaces where the axle keyhole openings 27 engage the axle 31.

In the preferred embodiment, after removal of the cover assembly 14 from the housing assembly 16 as, for example, shown in FIG. 34, the tab 74 remains coupled to the housing assembly 16. The tab 74, however, is preferably releasably coupled in a friction-fit arrangement with the button guide member 242 so that the button 74 may independently be removed from the housing 70 for separate cleaning as in a washing machine.

In another preferred arrangement, the cover 18 may include a resilient button cover portion 333 shown in broken lines in FIG. 32 which covers and encloses the button opening 247 yet permit a user's finger to deflect the resilient button cover portion downwardly sufficiently to operatively move the button 74. Such a button cover portion 333 may, for example, comprise a resilient sheet of flexible silicone that over the button opening 247 sealably engages to the top wall 21.

The preferred embodiments illustrate one particular arrangement for a pump mechanism and a bottle for the fluid dispensers. Various other pump arrangements and arrangements of pumps and bottles may be utilized. For example, the pump mechanism and bottle may be removed separately or the pump mechanism and bottle may be provided as an integral unit which is removed as a unit. The preferred embodiments illustrate the use of a piston pump which has similarities to the piston pump disclosed in U.S. Patent Publication US 2008/0121644 to Ophardt et al, published May 29, 2008. The pump mechanism, however, is not limited to the use of a piston pump mechanism and various other pump mechanisms may be provided which are activated by movement of the lever.

The dispenser 9 as shown in FIG. 1 is secured to a stand 11. The dispenser may be supported on any support structures such as, for example, may be coupled to a wall.

In the preferred embodiment, the axle keyway openings 27 are shown to extend through a rear edge of each of the side walls 22 and 23. Insofar as the side walls may have a portion which extends rearwardly beyond the top wall, then it is possible for the axle keyway openings 27 to open upwardly through an upper edge of each of the side walls.

The manner of coupling the lever 19 to the side wall is illustrated in accordance with the present invention on a cover 18 that is generally open forwardly. The cover 18, however, may be closed on its front face bridging between the side walls. Each axle keyway opening may be provided to extend to a bottom edge of each of the side walls or to a rear edge of each of the side walls at the lower rear edge of the side walls. Thus, the axle keyway openings may be provided through the cover side walls at a convenient location. The advantageous manner of mounting the lever 19 to the cover through the axle keyway openings 27 in the cover can be adapted, for example, to have a lever 19 proximate the lower end of the cover and operative to engage a pump mechanism, for example, disposed in a lower portion of the dispenser assembly.

The preferred embodiment illustrates a preferred arrangement for providing for vertical sliding of the cover 18 relative to the housing assembly with upwardly located right and left latch members engaged within slide grooves in the cover side walls. Alternate configurations for the latch members and the slide grooves may be provided which guide the cover in vertical sliding relative to the housing assembly.

The preferred embodiment illustrates the rod member as also providing for guided sliding of the cover relative to the housing assembly vertically as well as for pivoting about the rod member. Substitute structures may be provided in which the equivalent of the rod member is carried, for example, as stub axles on the housing side walls and slide grooves on the cover side wall.

In the preferred embodiments, the rod receiving groove and the housing side walls open through a bottom edge of the housing side walls. This is not necessary and it is to be appreciated that the rod retaining slots may open through the front edges of the housing side walls.

While the invention has been described with reference to preferred embodiments, many modifications and variations will now occur to persons skilled in the art. For a definition of the invention, reference is made to the accompanying drawings.

We claim:

1. A fluid dispenser having:

a housing, a cover removably coupled to the housing, the cover having a right cover side wall and a left cover side wall secured together spaced laterally from each other and being a mirror image of each other, each cover side wall having an upper portion, a lower portion and an intermediate portion spanning between the upper portion and the lower portion, a top bridging member bridging between the upper portion of the right cover side wall and the upper portion of left cover side wall, a bottom bridging member bridging between the lower portion of the right cover side wall and the lower portion of left cover side wall, the intermediate portion of the right cover side wall having a right latch member with a forwardly facing right latch surface, the intermediate portion of the left cover side wall having a left latch member with a forwardly facing left latch surface, the housing having on a right lateral side a right stop member carrying a rearwardly facing right stop surface, the housing having on a left lateral side a left stop member carrying a rearwardly facing left stop surface, the intermediate portion of the right cover side wall being resilient and having an inherent bias to adopt a right inherent condition, the intermediate portion of the right cover side wall being deflectable from the right inherent condition laterally toward the right to a right deflected condition in which the intermediate portion of the right cover side wall is laterally to the right of the right inherent condition, the intermediate portion of the left cover side wall being resilient and having an inherent bias to adopt a left inherent condition, the intermediate portion of the left cover side wall being deflectable from the left inherent condition laterally toward the left to a left deflected condition in which the intermediate portion of the left cover side wall is laterally to the left of the left inherent condition, when the cover is coupled to the housing with the intermediate portion of the right cover side wall in the right inherent condition and the intermediate portion of the left cover side wall in the left inherent condition, the right stop member of the housing interacts with the right latch member with engagement between the forwardly facing right latch surface and the rearwardly facing right stop surface and the left stop member of the housing interacts with the left latch member with engagement between the forwardly facing left latch surface and the rearwardly facing left stop surface preventing uncoupling of the cover from the housing by relative forward movement of the cover relative the housing, when the cover is coupled to the housing with the intermediate portion of the right cover side wall in the right inherent condition and the intermediate portion of the left cover side wall in the left inherent condition, with deflection of the intermediate portion of the right cover side wall to the right deflected condition and deflection of the intermediate portion of the left cover side wall to the left deflected condition, the right latch member is moved sufficiently to the right to clear the right stop member and the left latch member is moved sufficiently to the left to clear the left stop member that the cover can be moved forwardly relative the housing, the top bridging member comprises a top wall, and the bottom bridging member comprises a rod member extending laterally between the right cover side wall and the left cover side wall.

2. A dispenser as claimed in claim 1 wherein the housing has a right housing side wall and a left housing side wall, when the cover is coupled to the housing, the right cover side wall is laterally to the right of right housing side wall, the left cover side wall is laterally to the left of the left housing side wall, and the top wall extends between the right cover side wall and the left cover side wall above the right housing side wall and the left housing side wall.

3. A dispenser as claimed in claim 2 wherein the right housing side wall carrying the right stop member, and the left housing side wall carrying the left stop member.

4. A dispenser as claimed in claim 2 wherein:

each housing side wall having an identical slotway extending laterally therethrough, when the cover is coupled to the housing the rod member extending laterally through both the right housing side wall and the left housing side wall by being located within each of the slotways, when the rod member is within the slotways, the slotways engaging the rod member and guiding relative sliding movement of the lower portion of the cover relative to the housing.

5. A dispenser as claimed in claim 4 wherein the cover when coupled to the housing is movable between a closed lower position in which the dispenser is operative for dispensing fluid and an open upper position in which access is provided to an interior of the housing, in moving between the closed lower position and the open upper position, the cover is guided by the rod member sliding within the slotways.

6. A dispenser as claimed in claim 5 wherein each housing side wall having an edge, each slotway extending from an opening where the slotway is open through the edge of the respective housing side wall to a blind end, the rod member is slidable from the slotways through the openings to disengage the rod member from the slotways.

7. A dispenser as claimed in claim 6 wherein, when the cover is coupled to the housing, in the open upper position with the intermediate portion of the right cover side wall in the right inherent condition and the intermediate portion of the left cover side wall in the left inherent condition, with deflection of the intermediate portion of the right cover side wall to the right deflected condition and deflection of the intermediate portion of the left cover side wall to the left deflected condition so that the right latch member is moved sufficiently to the right to clear the right stop member and the left latch member is moved sufficiently to the left to clear the left stop member, then the cover can be moved forwardly relative the housing and the cover is pivotable about the rod member in the slotways to move the top wall of the cover forwardly and downwardly with the top wall to clear the housing and the cover is then movable relative the housing to slide the rod member from the slotways through the openings to disengage the rod member from the slotways.

8. A dispenser as claimed in claim 7 wherein the edge of each housing side wall is a downwardly directed bottom edge and each slotway extends from the opening upwardly to the blind end.

9. A dispenser as claimed in claim 7 wherein, in the closed lower position, the rod member is engaged within the slotways in a position intermediate the blind ends and the openings to the slotways.

10. A dispenser as claimed in claim 9 wherein, in moving the cover relative the housing between the closed lower position and the open upper position, engagement between the cover and the housing stops upward movement of the cover relative the housing in the upper position.

11. A fluid dispenser having:

a housing, a cover removably coupled to the housing, the cover having a right cover side wall and a left cover side wall secured together spaced laterally from each other and being a mirror image of each other, each cover side wall having an upper portion, a lower portion and an intermediate portion spanning between the upper portion and the lower portion, a top bridging member bridging between the upper portion of the right cover side wall and the upper portion of left cover side wall, a bottom bridging member bridging between the lower portion of the right cover side wall and the lower portion of left cover side wall, the intermediate portion of the right cover side wall having a right latch member with a forwardly facing right latch surface, the intermediate portion of the left cover side wall having a left latch member with a forwardly facing left latch surface, the housing having on a right lateral side a right stop member carrying a rearwardly facing right stop surface, the housing having on a left lateral side a left stop member carrying a rearwardly facing left stop surface, the intermediate portion of the right cover side wall being resilient and having an inherent bias to adopt a right inherent condition, the intermediate portion of the right cover side wall being deflectable from the right inherent condition laterally toward the right to a right deflected condition in which the intermediate portion of the right cover side wall is laterally to the right of the right inherent condition, the intermediate portion of the left cover side wall being resilient and having an inherent bias to adopt a left inherent condition, the intermediate portion of the left cover side wall being deflectable from the left inherent condition laterally toward the left to a left deflected condition in which the intermediate portion of the left cover side wall is laterally to the left of the left inherent condition, when the cover is coupled to the housing with the intermediate portion of the right cover side wall in the right inherent condition and the intermediate portion of the left cover side wall in the left inherent condition, the right stop member of the housing interacts with the right latch member with engagement between the forwardly facing right latch surface and the rearwardly facing right stop surface and the left stop member of the housing interacts with the left latch member with engagement between the forwardly facing left latch surface and the rearwardly facing left stop surface preventing uncoupling of the cover from the housing by relative forward movement of the cover relative the housing, when the cover is coupled to the housing with the intermediate portion of the right cover side wall in the right inherent condition and the intermediate portion of the left cover side wall in the left inherent condition, with deflection of the intermediate portion of the right cover side wall to the right deflected condition and deflection of the intermediate portion of the left cover side wall to the left deflected condition, the right latch member is moved sufficiently to the right to clear the right stop member and the left latch member is moved sufficiently to the left to clear the left stop member that the cover can be moved forwardly relative the housing, the housing has a right housing side wall and a left housing side wall, the right cover side wall carrying the right stop member, and the left cover side wall carrying the left stop member, when the cover is coupled to the housing, the right cover side wall is laterally to the right of right housing side wall, the left cover side wall is laterally to the left of the left housing side wall, and the top bridging member extends between the right cover side wall and the left cover side wall above the right housing side wall and the left housing side wall, a right slide groove extending laterally through the right housing side wall, the right latch member extends laterally inwardly to the left from the right cover side wall to a distal inner end, when the cover is coupled to the housing with the intermediate portion of the right cover side wall in the right inherent condition the right latch member extends laterally through the right slide groove and is vertically slidable in the right slide groove to guide the cover in sliding vertically relative the housing, a left slide groove extending laterally through the left housing side wall, the left latch member extends laterally inwardly to the right from the left cover side wall to a distal inner end, when the cover is coupled to the housing with the intermediate portion of the left cover side wall in the left inherent condition the left latch member extends laterally through the left slide groove and is vertically slidable in the left slide groove to guide the cover in sliding vertically relative the housing, wherein the cover when coupled to the housing is movable between a closed lower position in which the dispenser is operative for dispensing fluid and an open upper position in which access is provided to an interior of the housing, in moving between the closed lower position and the open upper position, the cover is guided by the right latch member sliding within the right slide groove and the left latch member sliding within the left slide groove.

12. A dispenser as claimed in claim 11 wherein the right latch member is joined to the right cover side wall at an outer end and extends laterally inwardly to the left to the distal inner end of the right latch member, the distal inner end of the right latch member comprises an enlarged right bulbous portion, the right latch member having a reduced width portion intermediate the outer end and the right bulbous portion, the reduced width portion having a front to back width less than a front to back width of the right bulbous portion, the right slide groove has a front to back width over a length of the right slide groove, the right slide groove including a first portion having a first front to back width over a first length greater than the front to back width of the right bulbous portion and a length sufficient to permit the right latch member to slide laterally into and out of the right slide groove with deflection of the intermediate portion of the right cover side wall between the right inherent condition and the right deflected condition, the right slide groove including a second portion having a second front to back width over a second length less than the front to back width of the right bulbous portion which second portion prevents the right latch member from sliding laterally out of the right slide groove with deflection of the intermediate portion of the right cover side wall from the right inherent condition to the right deflected condition, the left latch member is joined to the left cover side wall at an outer end and extends laterally inwardly to the right to the distal inner end of the left latch member, the distal inner end of the left latch member comprises an enlarged left bulbous portion, the left latch member having a reduced width portion intermediate the outer end and the left bulbous portion, the reduced width portion having a front to back width less than a front to back width of the left bulbous portion, the left slide groove has a front to back width over a length of the left slide groove, the left slide groove including a first portion having a first front to back width over a first length greater than the front to back width of the left bulbous portion and a length sufficient to permit the left latch member to slide laterally into and out of the left slide groove with deflection of the intermediate portion of the left cover side wall between the left inherent condition and the left deflected condition, the left slide groove including a second portion having a second front to back width over a second length less than the front to back width of the left bulbous portion which second portion which prevents the left latch member from sliding laterally out of the left slide groove with deflection of the intermediate portion of the left cover side wall from the left inherent condition to the left deflected condition.

13. A dispenser as claimed in claim 12 wherein when the cover is coupled to the housing in the open upper position relative the housing, the first portion of the right slide groove is laterally aligned with the right latch member and the first portion of the left slide groove is laterally aligned with the left latch member, permitting movement of the right latch member into and out of the right slide groove with deflection of the right intermediate portion of the right cover side wall between the undeflected condition and deflected condition and movement of the left latch member into and out of the left slide groove with deflection of the left intermediate portion of the left cover side wall between the undeflected condition and deflected condition.

14. A dispenser as claimed in claim 13 including a stop mechanism to limit sliding of the cover relative the housing in the open upper position selected from one or more of the group consisting of:

(a) the right slide groove extending vertically from a right top end, the right latch member when received in the right slide groove slides vertically in the right slide groove engaging the right top end to limit sliding of the cover upwardly relative the housing in the open upper position, and (b) the left slide groove extending vertically from a left top end, the left latch member when received in the left slide groove slides vertically in the left slide groove engaging the left top end to limit sliding of the cover upwardly relative the housing in the open upper position.

15. A dispenser as claimed in claim 13 wherein:

the bottom bridging member comprises a rod member extending laterally between the right cover side wall and the left cover side wall, the right housing side wall having an edge, the left housing side wall having an edge, the right housing side wall having a right slotway extending laterally therethrough, the left housing side wall having a left slotway extending laterally therethrough identical to the right slotway, the right slotway extending from an opening where the right slotway is open through the edge of the right housing side wall to a right blind end, the left slotway extending from an opening where the left slotway is open through the edge of the left housing side wall to a left blind end, when the cover is coupled to the housing the rod member extending laterally through the right housing side wall by being located within the right slotway and the rod member extending laterally through the left housing side wall by being located within the left slotway, when the rod member is within the right slotway and the left slotway, the right slotway and the left slotway engaging the rod member and guiding relative sliding movement of the lower portion of the cover relative to the housing, the rod member is slidable from the right slotway and the left slotway through the openings to disengage the rod member from the right slotway and left slotway, the cover when coupled to the housing to be movable between the closed lower position and the open upper position, in moving between the closed lower position and the open upper position, the cover is guided by both: (a) the right latch member sliding within the right slide groove and the left latch member sliding within the left slide groove, and (b) the rod member sliding within the right slotway and the left slotway, when the cover is coupled to the housing with:

(a) the intermediate portion of the right cover side wall in the right inherent condition and the right latch member extending laterally through the right slide groove vertically slidable in the right slide groove, (b) the intermediate portion of the left cover side wall in the left inherent condition and the left latch member extending laterally through the left slide groove vertically slidable in the left slide groove, and the rod member is within the right slotway and the left slotway vertically slidable in the right slotway and the left slotway:

the right slide groove engages the right latch member and the left slide groove engages the left latch member to stop downward movement sliding of the cover downwardly relative the housing in the closed lower position in which the rod member is engaged within the right slotway against removal via the opening in the right slotway in a position intermediate the blind end of the right slotway and the opening to the right slotway and within the left slotway against removal via the opening in the left slotway the slotways against removal in a position intermediate the blind ends of the left slotway and the openings to the left slotway.

16. A dispenser as claimed in claim 11 wherein the bottom bridging member comprises a rod member extending laterally between the right cover side wall and the left cover side wall, the right housing side wall having an edge, the left housing side wall having an edge, the right housing side wall having a right slotway extending laterally therethrough, the left housing side wall having a left slotway extending laterally therethrough identical to the right slotway, the right slotway extending from an opening where the right slotway is open through the edge of the right housing side wall to a right blind end, the left slotway extending from an opening where the left slotway is open through the edge of the left housing side wall to a left blind end, when the cover is coupled to the housing the rod member extending laterally through the right housing side wall by being located within the right slotway and the rod member extending laterally through the left housing side wall by being located within the left slotway, when the rod member is within the right slotway and the left slotway, the right slotway and the left slotway engaging the rod member and guiding relative sliding movement of the lower portion of the cover relative to the housing, the rod member is slidable from the right slotway and the left slotway through the openings to disengage the rod member from the right slotway and left slotway.

17. A dispenser as claimed in claim 15 wherein the cover when coupled to the housing to be movable between the closed lower position and the open upper position, in moving between the closed lower position and the open upper position, the cover is guided by both;(a) the right latch member sliding within the right slide groove and the left latch member sliding within the left slide groove and (b) the rod member sliding within the right slotway and the left slotway.

18. A dispenser as claimed in claim 17 wherein when the cover is coupled to the housing, in the open upper position with the intermediate portion of the right cover side wall in the right inherent condition and the intermediate portion of the left cover side wall in the left inherent condition, with deflection of the intermediate portion of the right cover side wall to the right deflected condition and deflection of the intermediate portion of the left cover side wall to the left deflected condition so that the right latch member is moved sufficiently to the right to clear the right stop member and the left latch member is moved sufficiently to the left to clear the left stop member, then the cover can be moved forwardly relative the housing and the cover is pivotable about the rod member in the right slotway and the left slotway to move the top bridging member of the cover forwardly and downwardly with the top bridging member to clear the housing and the cover is then movable relative the housing to slide the rod member from the slotways through the openings to disengage the rod member from the slotways.

19. A dispenser as claimed in claim 18 wherein when the cover is coupled to the housing with:

(a) the intermediate portion of the right cover side wall in the right inherent condition and the right latch member extending laterally through the right slide groove vertically slidable in the right slide groove, (b) the intermediate portion of the left cover side wall in the left inherent condition and the left latch member extending laterally through the left slide groove vertically slidable in the left slide groove, and the rod member is within the right slotway and the left slotway vertically slidable in the right slotway and the left slotway:

the right slide groove engages the right latch member and the left slide groove engages the left latch member to stop sliding of the cover downwardly relative the housing in the closed lower position in which the rod member is engaged within the right slotway against removal via the opening in the right slotway in a position intermediate the blind end of the right slotway and the opening to the right slotway and within the left slotway against removal via the opening in the left slotway in a position intermediate the blind end of the left slotway and the openings to the left slotway.

20. A dispenser as claimed in claim 18 including a stop mechanism to limit sliding of the cover relative the housing in the open upper position selected from one or more of the group consisting of:

(a) the right slide groove extending vertically from a right top end, the right latch member when received in the right slide groove slides vertically in the right slide groove engaging the right top end to limit sliding of the cover upwardly relative the housing in the open upper position, (b) the left slide groove extending vertically from a left top end, the left latch member when received in the left slide groove slides vertically in the left slide groove engaging the left top end to limit sliding of the cover upwardly relative the housing in the open upper position, (c) when the rod member is within the right slotway the rod member engaging the right blind end to limit sliding of the cover upwardly relative the housing in the open upper position, and (d) when the rod member is within the left slotway the rod member engaging the left blind end to limit sliding of the cover upwardly relative the housing in the open upper position.

21. A dispenser as claimed in claim 18 including a stop mechanism to limit sliding of the cover relative the housing in the open upper position selected from one or more of the group consisting of:

(a) the right slide groove extending vertically from a right top end, the right latch member when received in the right slide groove slides vertically in the right slide groove engaging the right top end to limit sliding of the cover upwardly relative the housing in the open upper position, and (b) the left slide groove extending vertically from a left top end, the left latch member when received in the left slide groove slides vertically in the left slide groove engaging the left top end to limit sliding of the cover upwardly relative the housing in the open upper position.

* * * * *